US010975631B2

(12) United States Patent
Morrison et al.

(10) Patent No.: US 10,975,631 B2
(45) Date of Patent: Apr. 13, 2021

(54) APPARATUS AND METHOD FOR RUNNING CASING INTO A WELLBORE

(71) Applicant: Impact Selector International, LLC, Houma, LA (US)

(72) Inventors: Jeremy Todd Morrison, Pickton, TX (US); James Patrick Massey, Breckenridge, CO (US); Jason Allen Hradecky, Heath, TX (US)

(73) Assignee: Impact Selector International, LLC, Houma, LA (US)

( * ) Notice: Subject to any disclaimer, the term of this patent is extended or adjusted under 35 U.S.C. 154(b) by 0 days.

(21) Appl. No.: 16/554,101

(22) Filed: Aug. 28, 2019

(65) Prior Publication Data

US 2020/0072001 A1 Mar. 5, 2020

Related U.S. Application Data

(60) Provisional application No. 62/724,229, filed on Aug. 29, 2018.

(51) Int. Cl.

| | |
|---|---|
| ***E21B 17/10*** | (2006.01) |
| ***E21B 17/08*** | (2006.01) |
| *E21B 17/20* | (2006.01) |

(52) U.S. Cl.

CPC ..... *E21B 17/08* (2013.01); *E21B 17/203* (2013.01)

(58) Field of Classification Search

CPC ..... E21B 17/1057; E21B 17/1064; E21B 17/1078; E21B 17/08

See application file for complete search history.

(56) References Cited

U.S. PATENT DOCUMENTS

| | | | | |
|---|---|---|---|---|
| 1,699,087 | A * | 1/1929 | Woodmansee | E21B 17/1057 166/241.3 |
| 1,877,395 | A * | 9/1932 | Goeser | E21B 17/1064 175/325.3 |
| 2002/0020526 | A1* | 2/2002 | Male | E21B 17/1057 166/241.6 |
| 2005/0092527 | A1* | 5/2005 | Le | E21B 17/1007 175/325.6 |
| 2010/0252274 | A1 | 10/2010 | Buytaert et al. | |
| 2010/0276138 | A1 | 11/2010 | Wittman et al. | |
| 2012/0255744 | A1 | 10/2012 | Shaikh et al. | |
| 2017/0074055 | A1 | 3/2017 | Eidem et al. | |
| 2021/0002966 | A1* | 1/2021 | Church | E21B 17/10 |

FOREIGN PATENT DOCUMENTS

| | | |
|---|---|---|
| CN | 201354595 Y | 12/2009 |
| GB | 2522077 A | 7/2015 |

OTHER PUBLICATIONS

PCT/US2019/048590 Written Opinion and Search Report dated Feb. 10, 2020, 11 pages.

* cited by examiner

*Primary Examiner* — Cathleen R Hutchins
(74) *Attorney, Agent, or Firm* — Boisbrun Hofman, PLLC

(57) ABSTRACT

Apparatus and methods for running casing into a wellbore. An apparatus may be or include a casing collar configured to couple together a first casing joint and a second casing joint. The casing collar may have a body and a plurality of rotatable members connected to the body. The body may have a fluid passage extending axially therethrough, a first coupler configured to couple the casing collar with the first casing joint, and a second coupler configured to couple the casing collar with the second casing joint. At least a portion of each rotatable member may extend from the body in a radially outward direction.

20 Claims, 13 Drawing Sheets

APPARATUS AND METHOD FOR RUNNING CASING INTO A WELLBORE

CROSS-REFERENCE TO RELATED APPLICATIONS

This application claims priority to and the benefit of U.S. Provisional Patent Application No. 62/724,229, titled "APPARATUS AND METHOD FOR RUNNING CASING INTO A WELLBORE," filed on Aug. 29, 2018, the entire disclosure of which is hereby incorporated herein by reference.

BACKGROUND OF THE DISCLOSURE

Oil and gas wells are generally drilled into Earth's surface or ocean bed to recover natural deposits of oil, gas, and other natural resources that are trapped within subterranean geological formations. Wellbores for reaching the natural resources may be formed by drilling systems having various surface and subterranean equipment operating in a coordinated manner. After a wellbore is formed, a metal casing string may be inserted within the wellbore, such as to protect the sidewall of the wellbore, isolate different geological formations, and help maintain control of formation fluids and well pressure during various subsequent downhole operations. The casing string may be secured within the wellbore by cement injected into an annular space between an outer surface of the casing string and the sidewall of the wellbore.

Oil and gas reservoirs located within geological formations have conventionally been accessed by vertical or near-vertical wellbores. Casing strings may be inserted into the vertical and near-vertical wellbores utilizing gravity to facilitate conveyance or movement therethrough. Oil and gas reservoirs, however, are increasingly accessed via non-vertical wellbores. Casing strings that have conventionally been inserted within vertical and near-vertical wellbores may encounter problems when inserted within non-vertical wellbores. For example, in non-vertical wellbores, gravity may be negated by frictional forces between the casing string and the sidewall of the wellbore, which may resist movement of the casing string through the wellbore. Although the casing string may be pushed along the wellbore, friction generated against the sidewall of the wellbore may be greater than the available axial force to push the casing string downhole.

Furthermore, the outer surface of the casing string may stick to the sidewall of the wellbore, or the leading edge of the casing string or the leading edges of the casing collars of the casing string may dig into or jam against the sidewall of the wellbore, impeding downhole movement of the casing string. Movement of the casing string along a non-vertical wellbore may also be impeded by presence of various obstacles along the wellbore. For example, drill cuttings, washouts, and various imperfections (e.g., bumps, uneven surfaces) in the sidewall of the wellbore may further impede or increase resistance to movement of the casing string through the wellbore.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
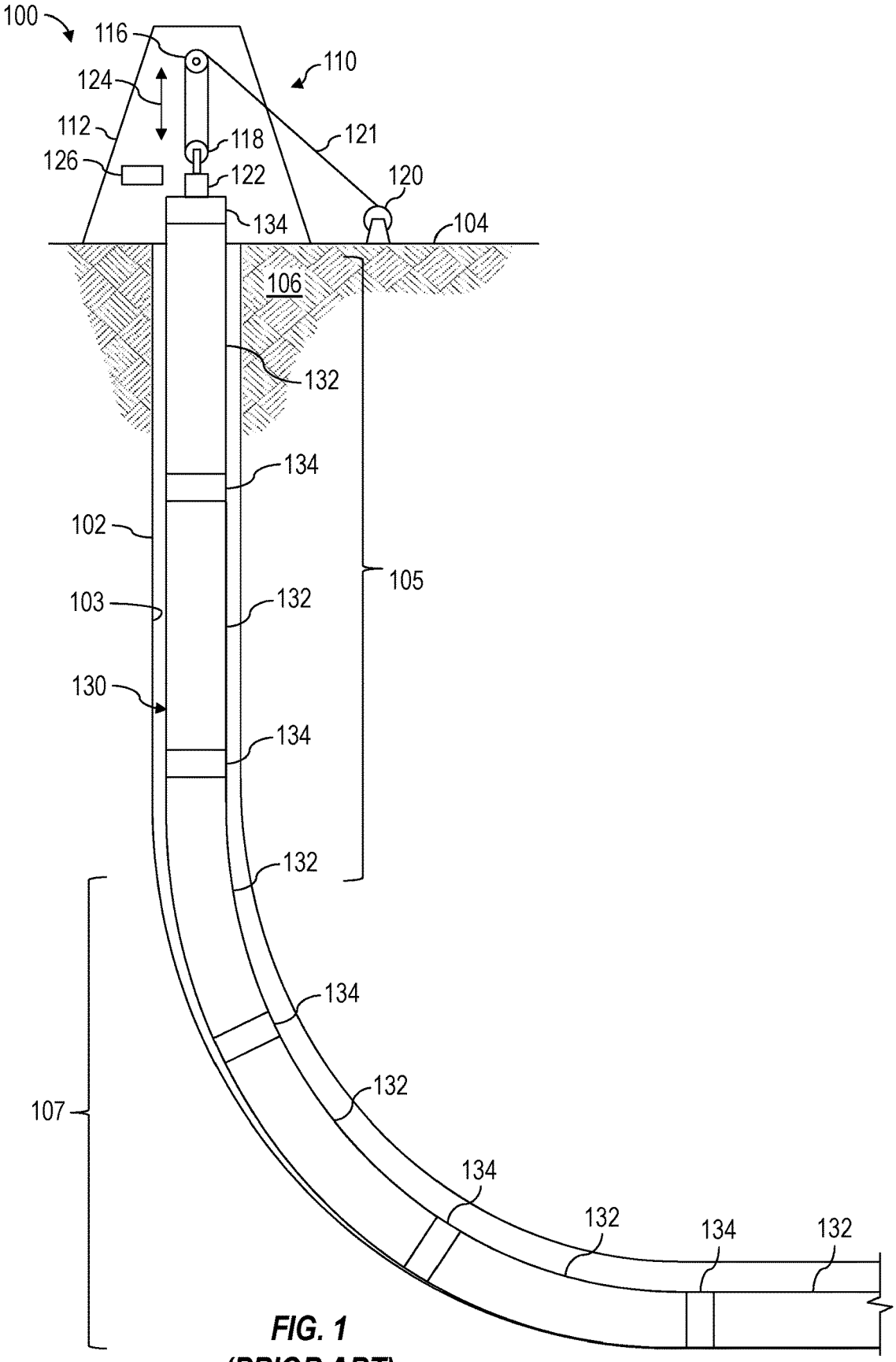
FIG. 1 (PRIOR ART)
FIG. 1 is a schematic view of prior art apparatus being conveyed along substantially vertical and non-vertical portions of a wellbore.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

Terms, such as upper, upward, above, lower, downward, and/or below are utilized herein to indicate relative positions and/or directions between apparatuses, tools, components, parts, portions, members and/or other elements described herein, as shown in the corresponding figures. Such terms do not necessarily indicate relative positions and/or directions when actually implemented. Such terms, however, may indicate relative positions and/or directions with respect to a wellbore when an apparatus according to one or more aspects of the present disclosure is utilized or otherwise disposed within the wellbore. For example, the term upper may mean in the uphole direction, and the term lower may mean in the downhole direction.

FIG. 1 is a schematic view of at least a portion of an example implementation of a well construction system 100, represents an example environment in which one or more aspects of the present disclosure described below may be implemented. The well construction system 100 is depicted in relation to a wellbore 102 formed by rotary and/or directional drilling from a wellsite surface 104 and extending into a subterranean formation 106. Although the well construction system 100 is depicted as an onshore implementation, aspects described below are also applicable to offshore implementations.

The well construction system 100 includes surface equipment 110 located at the wellsite surface 104 and a casing string 130 comprising a plurality of casing joints 132 suspended within the wellbore 102. The surface equipment 110 may be collectively operable to perform casing running operations (e.g., casing string assembly and lowering operations), which may include, receiving and positioning the casing joints 132, one at a time, above the wellbore 102, connecting the casing joints 132 to progressively assemble the casing string 130, and lowering the casing string 130 within the wellbore 102 each time a new casing joint 132 is connected. Adjacent casing joints 132 of the casing string 130 may be connected together via corresponding casing collars 134.

The surface equipment 110 may include a mast, a derrick, and/or another wellsite structure 112. The casing string 130 may be suspended within the wellbore 102 from the wellsite structure 112 via hoisting equipment, which may include a crown block 116 connected to or otherwise supported by the wellsite structure 112, a traveling block 118 operatively connected with the crown block via a support cable or line 121, and an elevator 122 connected to and supported by the traveling block 118. The hoisting equipment may further comprise a draw works 120 storing the support line 121. The crown block 116 and traveling block 118 may be or comprise pulleys or sheaves around which the support line 121 is reeved to operatively connect the crown block 116, the traveling block 118, and the draw works 120. The draw works 120 may thus selectively impart tension to the support line 121 to lift and lower the elevator 122, resulting in vertical motion 124 of the elevator 122. The draw works 120 may comprise a drum, a frame, and a prime mover (e.g., an engine or motor) operable to drive the drum to rotate and reel in the support line 121, causing the traveling block 118 and the elevator 122 to move upward. The draw works 120 may be operable to release the support line 121 via a controlled rotation of the drum, causing the traveling block 118 and the elevator 122 to move downward. The surface equipment 110 may further comprise a torqueing device 126 (e.g., tongs, iron roughneck) at the rig floor (not shown). The torqueing device 126 may be moveable toward, away from, and at least partially around a casing joint 132, such as may permit the torqueing device 126 to make up and break out casing joint connections to assemble and disassemble the casing string 130.

Each casing joint 132 may have a casing collar 134 threadedly or otherwise connected at upper end thereof, forming a box (i.e. female) end of the casing joint 132. During casing running operations, the casing joints 132 may be successively made up and tripped (i.e., lowered) into the wellbore until the casing string 130 has a predetermined length and/or reaches a predetermined depth (e.g., measured depth (MD)) within the wellbore 102. For example, a new casing joint 132 may be conveyed to the rig floor until the casing collar 134 projects above the rig floor. The elevator 122 may then grasp the new casing joint 132 by the casing collar 134 and the draw works 120 may lift the new casing joint 132 above a previously connected casing joint 132 protruding from the wellbore 102. A set of slips (not shown) may hold the previously connected casing joint 132 and, thus, the casing string 130, in position suspended within the wellbore 102. After a pin (i.e., male) end of the new casing joint 132 is positioned above and aligned with a box end of the previously connected casing joint 132, the draw works 120 may lower the new casing joint 132 until the pin end of the new casing joint 132 is at least partially inserted into the box end of the previously connected casing joint 132.

The torqueing device 126 may then be moved toward the casing string 130, clamped around the new casing joint 132, and operated to rotate the new casing joint 132 to threadedly engage the pin end of the new casing joint 132 with the box end of the previously connected casing joint 132 to make up the connection. In this manner, the new casing joint 132 becomes a part of the casing string 130. The torqueing device 126 may then be released and moved clear of the casing string 130. The slips may then be operated to an open position, and the draw works 120 may lower the casing string 130 to advance the casing string 130 downward (i.e., downhole) within the wellbore 102. When the box end of the newly connected casing joint 132 is near the slips and/or the rig floor, the draw works 120 may stop lowering the casing string 130, the slips may close to clamp the newly connected casing joint 132, and the elevator 122 may be detached from the newly connected casing joint 132.

Thereafter, another casing joint 132 may be conveyed to the rig floor, grasped by the elevator 122, and lifted above and connected with the previously connected casing joint 132 protruding from the wellbore 102. The slips may be opened again and the hoisting equipment may lower the casing string 130 to advance the casing string 130 downward within the wellbore 102. Such casing running operations may be repeated until the casing string 130 reaches a predetermined length and/or reaches a predetermined depth within the wellbore 102.

During the casing running operations, while the casing string 130 is lowered along a substantially vertical portion 105 of the wellbore 102, gravity (i.e., the weight of the casing string 130) causes the casing string 130 to move downwardly, perpendicularly to sidewall 103 of the wellbore 102. Thus, while the casing string 130 is lowered along the substantially vertical portion 105 of the wellbore 102, the sidewall 103 do not substantially impede the intended conveyance or movement of the casing string 130 within the wellbore 102.

However, while the casing string 130 is lowered along a non-vertical portion 107 (e.g., horizontal or otherwise deviated) of the wellbore 102, gravity causes the weight of the casing string 130 to be directed downwardly against the sidewall 103 of the wellbore 102. As a result, the sidewall 103 of the non-vertical portion 107 of the wellbore 102 cause friction against the casing string 130 and/or otherwise impede the intended conveyance or movement of the casing string 130 along the wellbore 102. Moreover, impacts, friction, vibrations, and other forces resulting from contact with the sidewall 103 may cause damage to the casing string 130 and/or the sidewall 103 when the casing string 130 is conveyed through the substantially non-vertical portion 107 of the wellbore 102.

Figure 2:
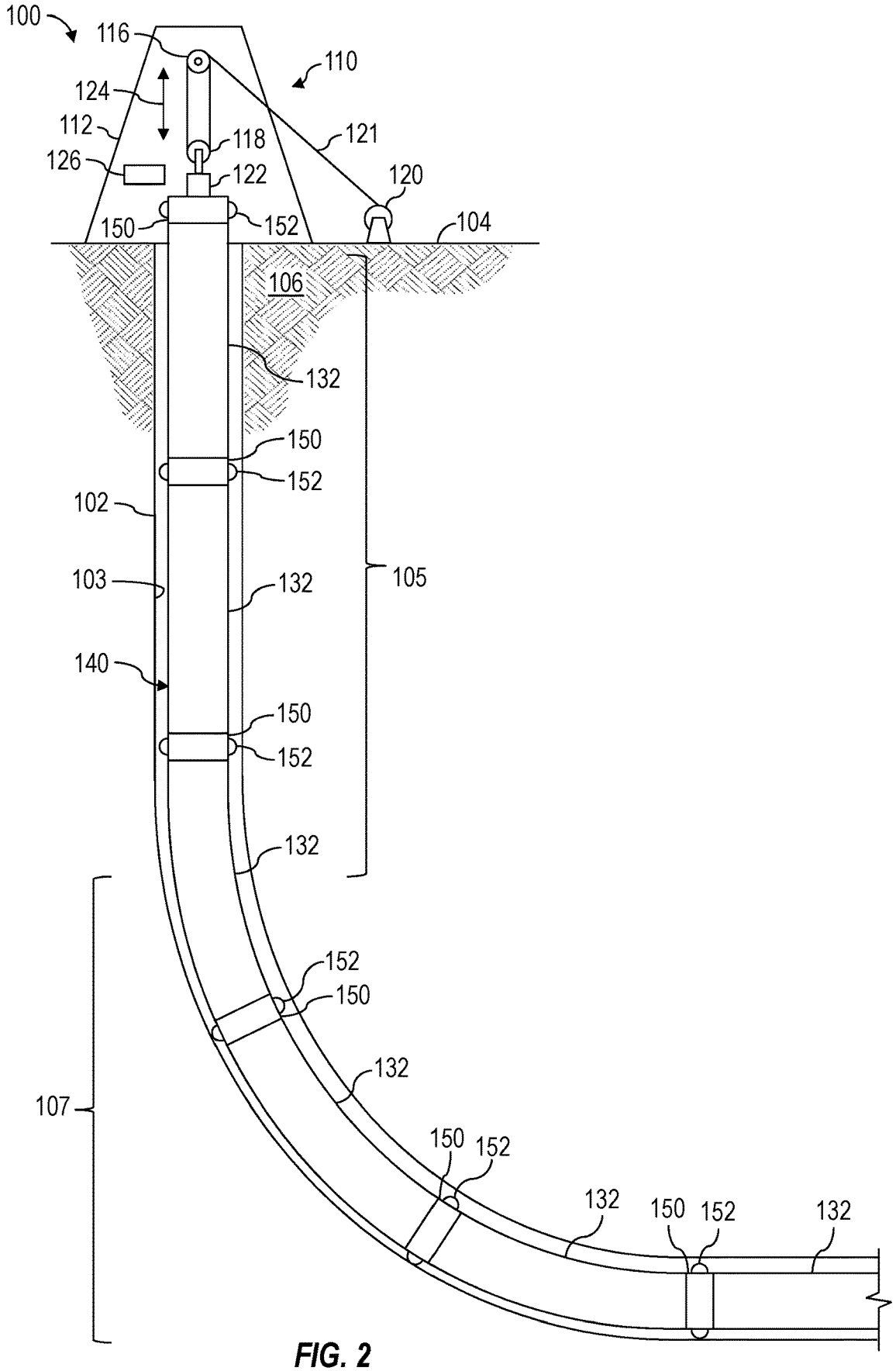
FIG. 2 is a schematic view of at least a portion of an example implementation of apparatus according to one or more aspects of the present disclosure.
Figure 3:
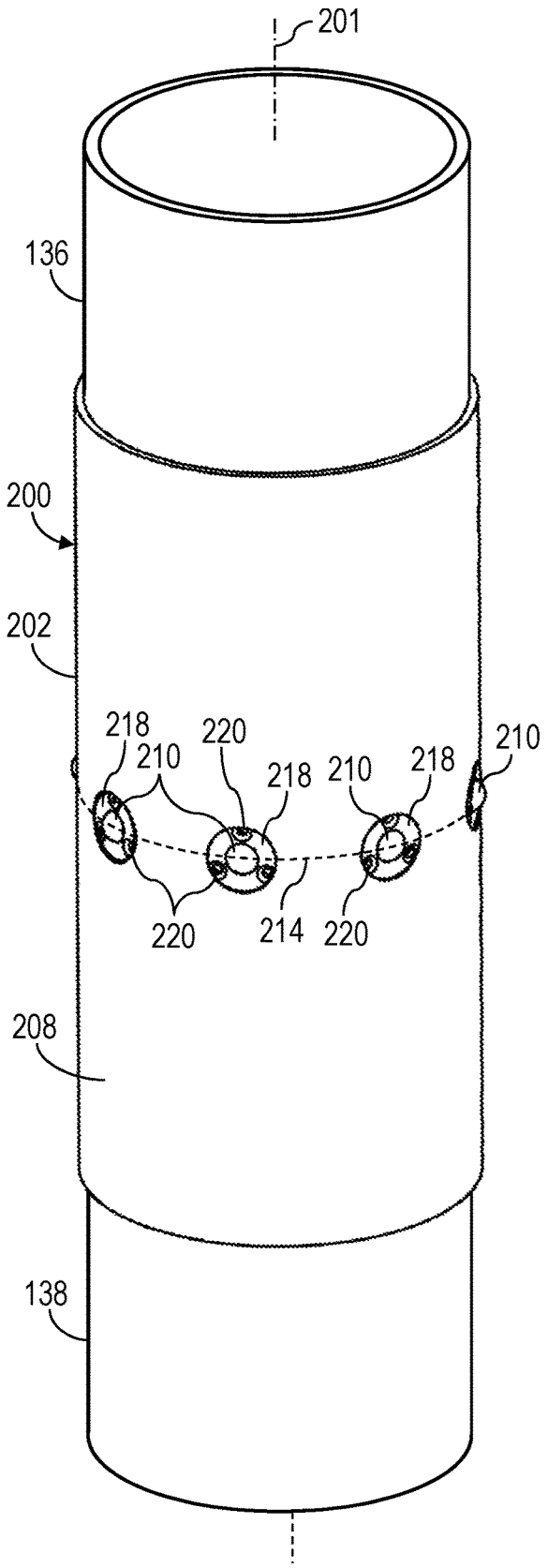
FIG. 3 is a perspective view of at least a portion of an example implementation of apparatus according to one or more aspects of the present disclosure.
Figure 6:
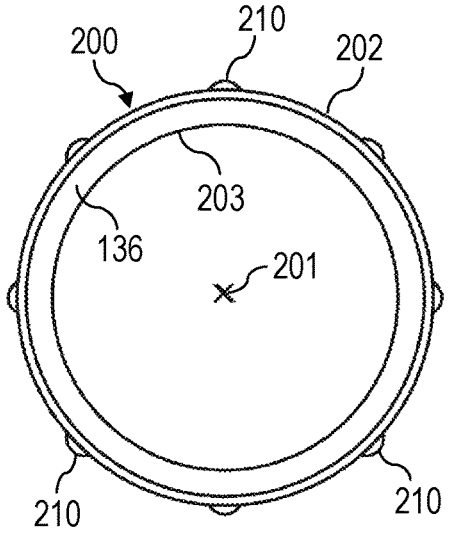
FIG. 6 is an axial view of the apparatus shown in FIG. 4 according to one or more aspects of the present disclosure.
Figure 7:
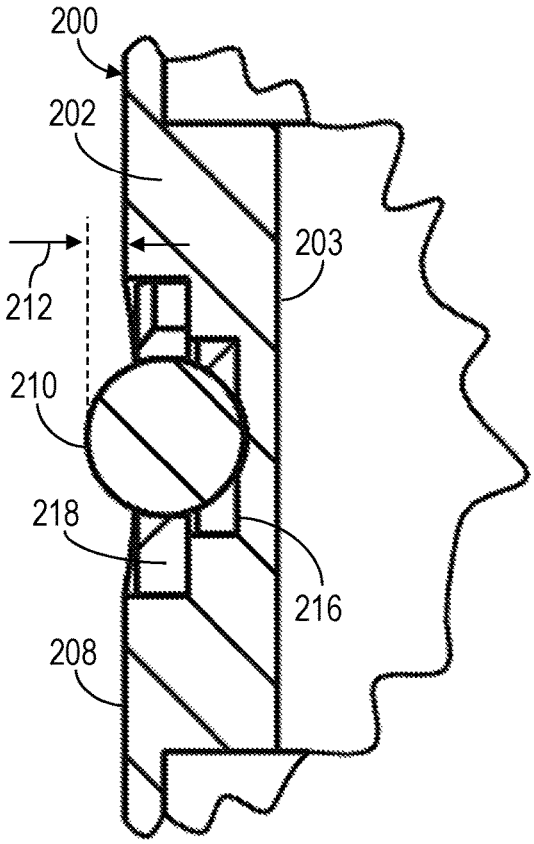
FIG. 7 is an enlarged view of a portion of the apparatus shown in FIG. 5 according to one or more aspects of the present disclosure.
Figure 4:
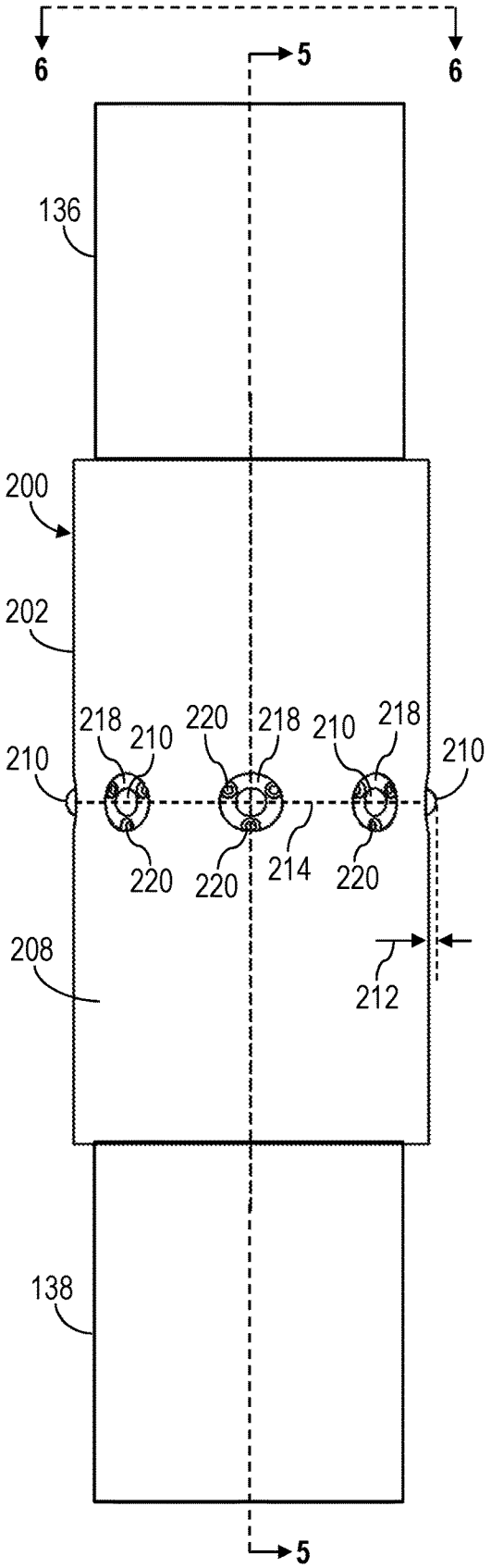
FIG. 4 is a side view of the apparatus shown in FIG. 3 according to one or more aspects of the present disclosure.
Figure 5:
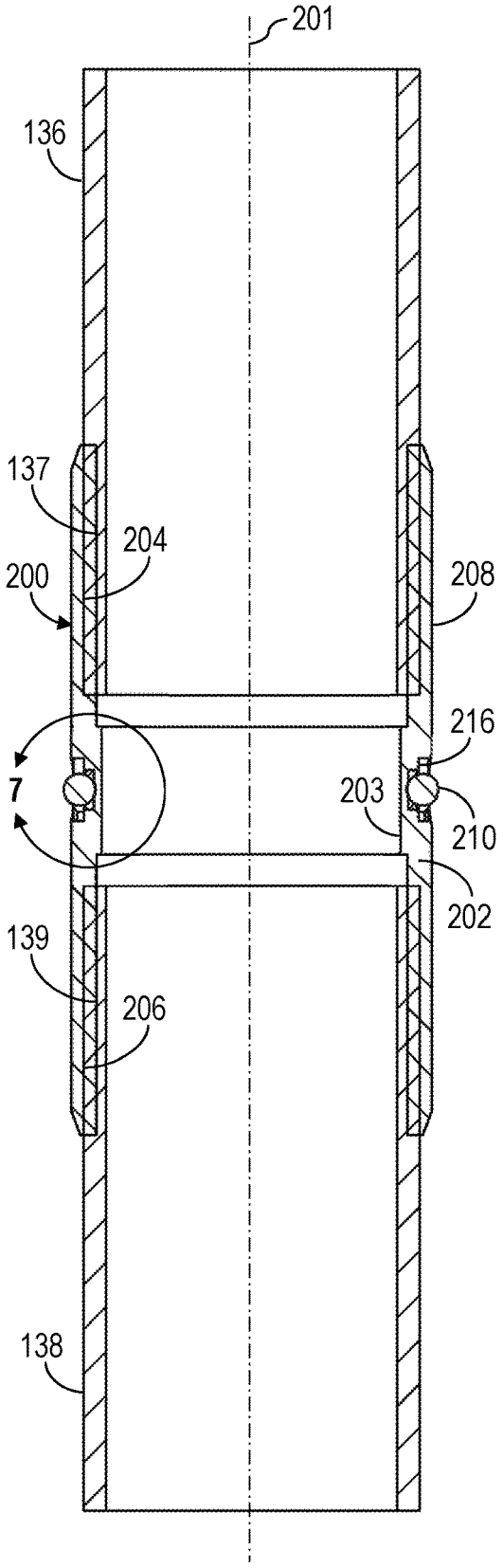
FIG. 5 is a sectional view of the apparatus shown in FIG. 4 according to one or more aspects of the present disclosure.
Figure 8:
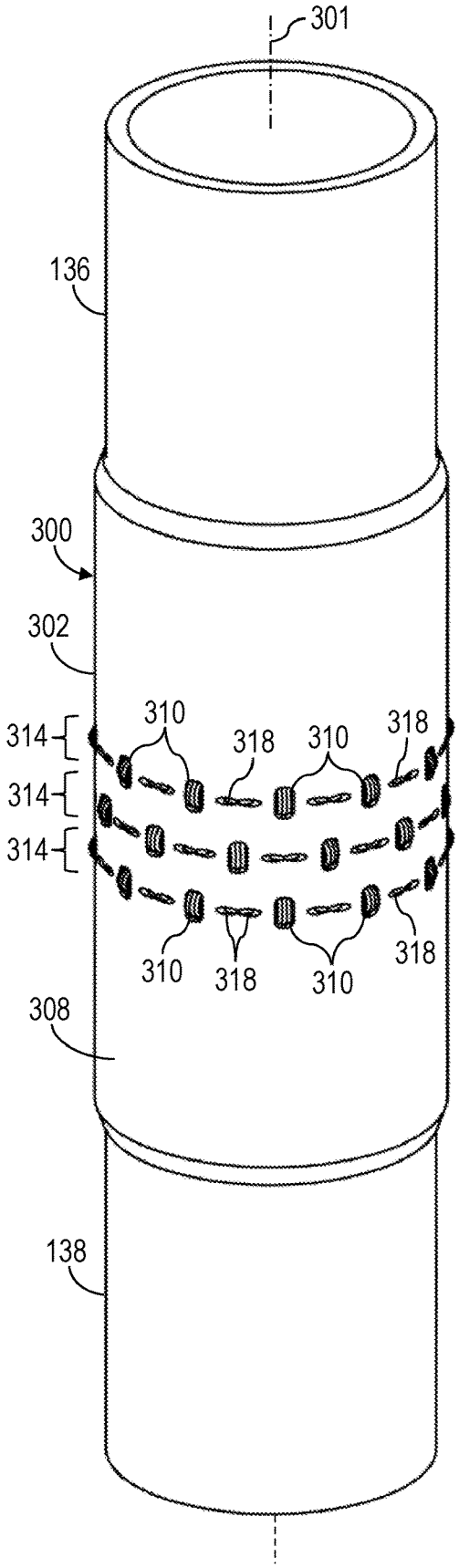
FIG. 8 is a perspective view of at least a portion of an example implementation of apparatus according to one or more aspects of the present disclosure.

Accordingly, the present disclosure is further directed to a conveyance (e.g., rolling) apparatus (e.g., device) that may aid in conveying or otherwise moving a casing string along a non-vertical portion of a wellbore, such as the non-vertical portion 107 of the wellbore 102. FIG. 2 is a schematic view of the well construction system 100 shown in FIG. 1, but running (i.e., making up and conveying) within the wellbore 102 a casing string 140 according to one or more aspects of the present disclosure. Unlike the casing string 130 shown in FIG. 1, the casing string 140 comprises or is utilized in association with a plurality of conveyance apparatuses 150 according to one or more aspects of the present disclosure.

Each conveyance apparatus 150 may form a portion of or be coupled with the casing string 140 and may include one or more rotatable members 152 (e.g., spheres, wheels, rollers, etc.) or other friction reducing members extending laterally (e.g., radially outward) from or past an outer surface of the casing string 140. During casing running operations, the conveyance apparatuses 150 may lift, support, or otherwise offset at least a portion of the casing string 140 away from the sidewall 103 of the wellbore 102, such as may reduce or inhibit contact and, thus, friction between portions (e.g., casing joints 132, casing collars 134) of the casing sting 140 and the sidewall 103. For example, the rotatable members 152 may contact the sidewall 103 of the wellbore 102 to permit the casing string 140 to roll along the sidewall 103 of the wellbore 102 along a longitudinal axis of the wellbore 102. The conveyance apparatuses 150 may thus help or otherwise facilitate conveyance of the casing string 140 within the non-vertical portion 107 of the wellbore 102 until the casing string 140 reaches a predetermined length and/or reaches a predetermined depth within the wellbore 102. The conveyance apparatuses 150 may maintain a space or gap between an outer surface of the casing string 140 and the sidewall 103 of the wellbore 102 and, thus, may be utilized in addition to or instead of casing centralizers (e.g., bow-spring centralizers) during casing running operations. During subsequent cementing operations, the conveyance apparatuses 150 may remain coupled with the casing string 140 and, thus, be cemented downhole with the casing string 140.

Each conveyance apparatus 150 may be, comprise, or operate as a casing collar and, thus, be utilized instead of a conventional casing collar (e.g., an instance of the casing collars 134 shown in FIG. 1) to threadedly or otherwise couple two casing joints 132 together. Such conveyance apparatuses 150 may be coupled with corresponding casing joints 132 to form the box ends of the casing joints 132 and to couple together adjacent casing joints 132 of the casing string 140. The conveyance apparatuses 150 may instead be utilized in addition to conventional casing collars 134. For example, the conveyance apparatuses 150 may be coupled with the casing string 140 around or otherwise with selected ones (e.g., every, some) of the conventional casing collars 134. Such conveyance apparatuses 150 may be coupled with the casing string 140 around the conventional casing collars 134 during casing running operations, for example, after each pin end of a new casing joint 132 threadedly engages a box end (i.e., a casing collar 134) of a previously connected casing joint 132 protruding from the wellbore 102. The conveyance apparatuses 150 may instead be coupled with the casing string 140 around or otherwise with selected ones (e.g., every, some) of the casing joints 132 between opposing conventional casing collars 134. The conveyance apparatuses 150 within the scope of the present disclosure may be connected with every casing collar 134 or casing joint 132, every other casing collar 134 or casing joint 132, or at other predetermined interval(s) or rate(s).

FIGS. 3-7 are perspective, side, side sectional, axial, and enlarged sectional views, respectively, of at least a portion of an example implementation of a conveyance apparatus 200 according to one or more aspects of the present disclosure. The conveyance apparatus 200 is shown coupling together or otherwise coupled between opposing upper and lower casing joints 136, 138. The following description refers to FIGS. 2-7, collectively.

The conveyance apparatus 200 may be, comprise, or operate as a casing collar and, thus, be utilized instead of a conventional casing collar (e.g., an instance of the casing collars 134 shown in FIG. 1) to threadedly or otherwise couple two casing joints together. In the oil and gas industry, opposing ends of casing joints may be or comprise pin ends (i.e., external threats). Prior to performing casing running operations, an instance of the conveyance apparatus 200 may be coupled to each casing joint to form the box end of the casing joint. Thereafter, during the casing running operations, the pin ends of the new casing joints may be coupled with the box ends (i.e., conveyance apparatuses 200) of the previously connected casing joints protruding from the wellbore 102.

The conveyance apparatus 200 may comprise a body 202 (e.g., a sleeve, a collar, a housing) having a generally tubular geometry with an inner surface 203 defining an axial bore extending therethrough to permit fluid passage between the upper and lower casing joints 136, 138 coupled with the conveyance apparatus 200. The body 202 may comprise an upper coupling means 204 for mechanically coupling the conveyance apparatus 200 with a corresponding lower coupling means 137 of the upper casing joint 136, and a lower coupling means 206 for mechanically coupling the conveyance apparatus 200 with a corresponding upper coupling means 139 of the lower casing joint 138. The interface means 204 may be or comprise internal (i.e., female) threads configured to threadedly engage with corresponding external (i.e., male) threads of the lower coupling means 137, and the interface means 206 may be or comprise internal threads configured to threadedly engage with corresponding external threads of the upper coupling means 139.

The conveyance apparatus 200 may further comprise a plurality of rollable or otherwise rotatable members 210 rotatably connected with and distributed circumferentially around the body 202. At least a portion of each rotatable member 210 may extend or protrude from or past an outer surface 208 of the body 202 by a predetermined distance 212 in a lateral or otherwise radially outward direction with respect a central axis 201 of the conveyance apparatus 200. Each rotatable member 210 may be or comprise a sphere, such as a ball bearing, which may be disposed in a corresponding cavity 216 extending within a wall of the body 202. Each rotatable member 210 may be retained within the corresponding cavity 216 via a corresponding retainer ring 218 having an opening that permits a portion of the corresponding rotatable member 210 to project or otherwise extend therethrough by the predetermined distance 212. Each retainer ring 218 may be maintained in position against a corresponding rotatable member 210 via one or more bolts 220 connecting the retainer ring 218 to the body 202.

Although the conveyance apparatus 200 is shown comprising eight rotatable members 210 distributed around the body 202, it is to be understood that the conveyance apparatus 200 may comprise a lesser or a greater quantity of rotatable members 210. Furthermore, although the conveyance apparatus 200 is shown comprising the rotatable members 210 distributed circumferentially around the body 202 along a single circumferential curve 214, the rotatable members 210 may instead be arranged in two, three, four, or more sets of rotatable members 210, each set comprising a plurality of rotatable members 210 distributed circumferentially around the body 202 along a different circumferential curve 214 each located at a different axial position along the body 202.

During casing running operations, the conveyance apparatuses 200 may collectively lift or support at least portions of the casing string 140 at a distance from the sidewall 103 of the wellbore 102, such as may reduce or inhibit contact and, thus, reduce friction between the portions of the casing sting 140 and the sidewall 103. For example, the rotatable members 210 of each conveyance apparatus 200 may contact the sidewall 103 of the wellbore 102 to lift the body 202 and at least a portion of the casing joints 136, 138 coupled with the body 202 away from the sidewall 103. Each conveyance apparatus 200 may maintain a space or gap between the sidewall 103 of the wellbore 102 and the body 202 (and at least a portion of the casing joints 136, 138 coupled with the body 202) that is about equal to the distance 212. The rotatable members 210 may further permit the corresponding portion of the casing string 140 to roll in an axial (i.e., longitudinal) direction along the sidewall 103 to reduce friction between the portions of the casing sting 140 and the sidewall 103. The rotatable members 210 may also permit the corresponding portion of the casing string 140 to rotate (e.g., roll, turn) within the wellbore 102, such as to reduce or inhibit torsional stresses along the casing string 140 and/or to maintain the casing string 140 against the low side of the wellbore 102.

FIGS. 8-12 are perspective, side, side sectional, axial, and enlarged sectional views, respectively, of at least a portion of an example implementation of a conveyance apparatus 300 according to one or more aspects of the present disclosure. The conveyance apparatus 300 is shown coupling together or otherwise coupled between opposing upper and lower casing joints 136, 138. The following description refers to FIGS. 2 and 8-12, collectively.

The conveyance apparatus 300 may be, comprise, or operate as a casing collar and, thus, be utilized instead of a conventional casing collar (e.g., an instance of the casing collars 134 shown in FIG. 1) to threadedly or otherwise couple two casing joints together. Prior to performing the casing running operations, a conveyance apparatus 300 may be coupled to each casing joint to form the box end of the casing joints. Thereafter, during the casing running operations, the pin ends of the new casing joints may be coupled with the box ends (i.e., conveyance apparatuses 300) of the previously connected casing joints protruding from the wellbore 102.

The conveyance apparatus 300 may comprise a body 302 (e.g., a sleeve, a collar, a housing) having a generally tubular geometry with an inner surface 303 defining an axial bore extending therethrough to permit fluid passage between the upper and lower casing joints 136, 138 coupled with the conveyance apparatus 300. The body 302 may comprise an upper coupling means 304 for mechanically coupling the conveyance apparatus 300 with a corresponding lower coupling means 137 of the upper casing joint 136, and a lower coupling means 306 for mechanically coupling the conveyance apparatus 300 with a corresponding upper coupling means 139 of the lower casing joint 138. The interface means 304 may be or comprise internal (i.e., female) threads configured to threadedly engage with corresponding external (i.e., male) threads of the lower coupling means 137, and the interface means 306 may be or comprise internal threads configured to threadedly engage with corresponding external threads of the upper coupling means 139.

The conveyance apparatus 300 may further comprise a plurality of rollable or otherwise rotatable members 310 rotatably connected with and distributed circumferentially around the body 302. At least a portion of each rotatable member 310 may extend or protrude from or past an outer surface 308 of the body 302 by a predetermined distance 312 in a lateral or otherwise radially outward direction with respect a central axis 301 of the conveyance apparatus 300. Each rotatable member 310 may be or comprise a wheel (e.g., having a generally cylindrical geometry) configured to rotate about a corresponding shaft 318 defining an axis of rotation extending substantially perpendicularly with respect to the central axis 301. Each rotatable member 310 may be disposed in a corresponding cavity 316 extending within a wall of the body 302 and retained within the cavity 316 via the corresponding shaft 318, which may extend through the cavity 316 and into the body 302 on opposing sides of the cavity 316.

Figure 11:
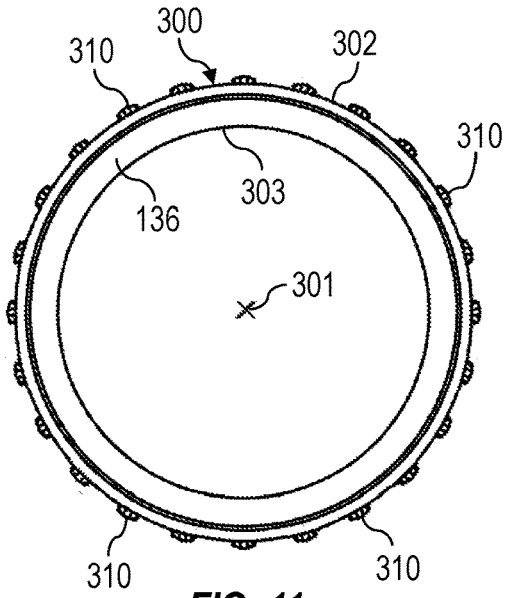
FIG. 11 is an axial view of the apparatus shown in FIG. 9 according to one or more aspects of the present disclosure.
Figure 12:
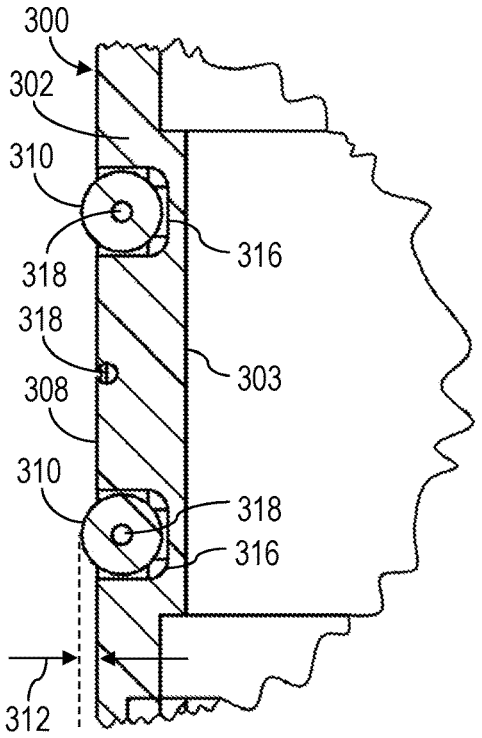
FIG. 12 is an enlarged view of a portion of the apparatus shown in FIG. 10 according to one or more aspects of the present disclosure.
Figure 9:
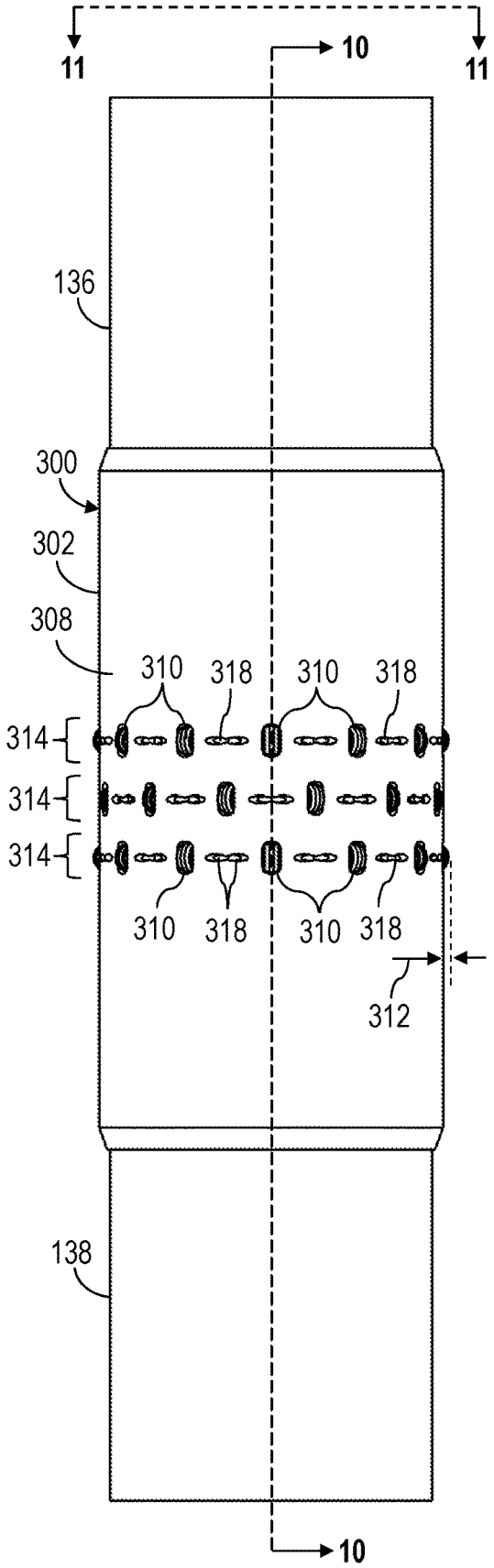
FIG. 9 is a side view of the apparatus shown in FIG. 8 according to one or more aspects of the present disclosure.
Figure 10:
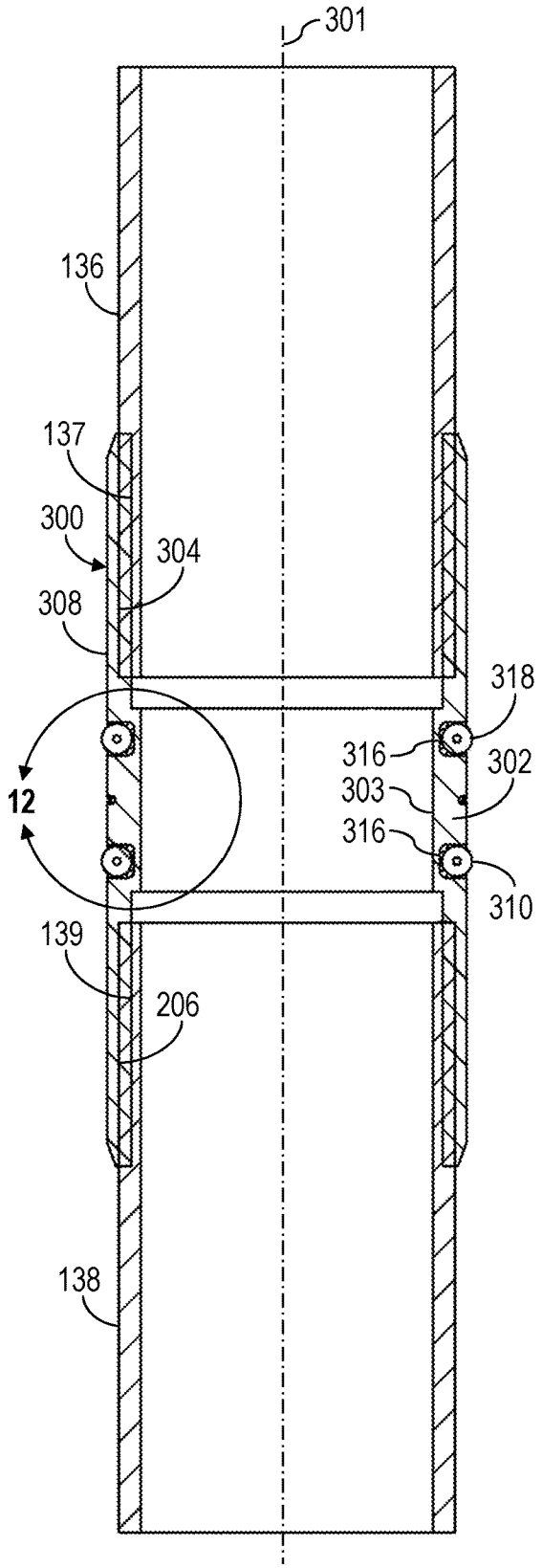
FIG. 10 is a sectional view of the apparatus shown in FIG. 9 according to one or more aspects of the present disclosure.
Figure 13:
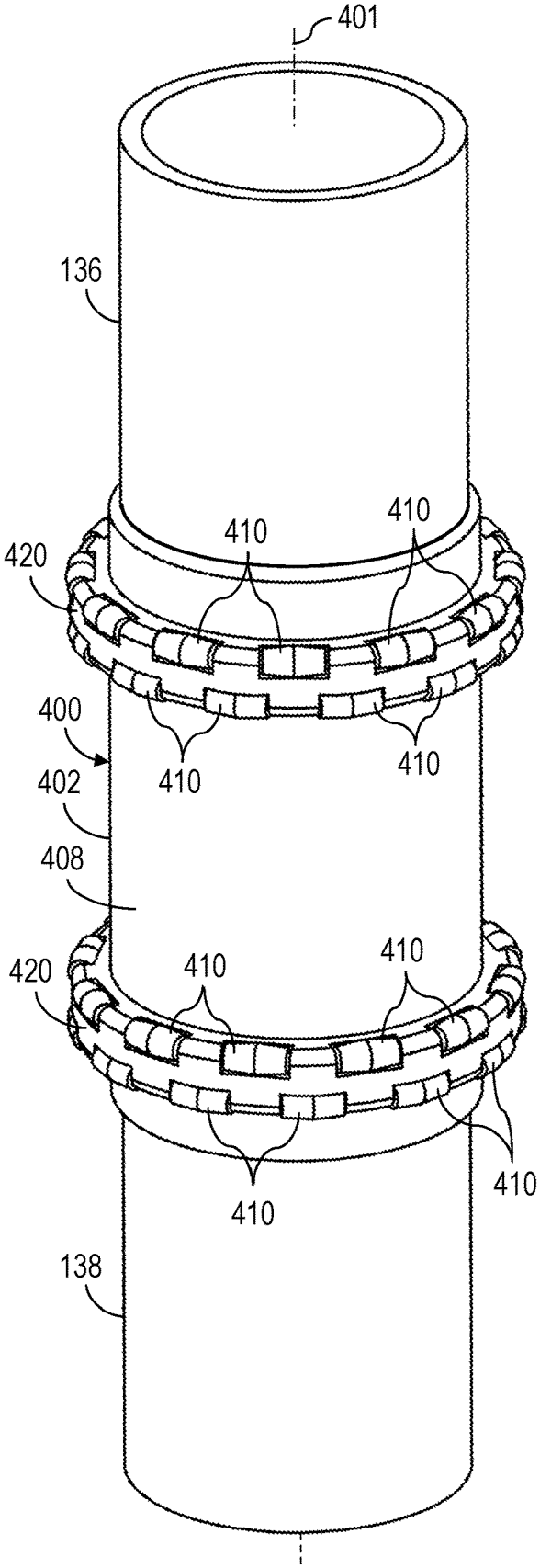
FIG. 13 is a perspective view of at least a portion of an example implementation of apparatus according to one or more aspects of the present disclosure.

The rotatable members 310 may be arranged in one or more sets 314 of rotatable members 310, each set 314 comprising a plurality of rotatable members 310 distributed circumferentially around the body 302 along a different circumferential curve. Each set 314 of rotatable members 310 may be located at a different axial position along the body 302. The rotatable members 310 of one or more sets 314 of rotatable members 310 may be azimuthally offset from the rotatable members 310 of one or more other sets 314 of rotatable members 310. Accordingly, although each set 314 of rotatable members 310 is shown comprising twelve rotatable members 310 distributed circumferentially around the body 302 every thirty degrees, the azimuthal offset results in the rotatable members 310 being distributed circumferentially around the body 302 every fifteen degrees, as shown in FIG. 11. Although the conveyance apparatus 300 is shown comprising three sets 314 of rotatable members 310, it is to be understood that the conveyance apparatus 300 may comprise one, two, four, or more sets 314 of rotatable members 310. Furthermore, although each set 314 of rotatable members 310 is shown comprising twelve rotatable members 310, it is to be understood that each set 314 of rotatable members 310 may comprise a lesser or a greater quantity of rotatable members 310.

During casing running operations, the conveyance apparatuses 300 may collectively lift or support at least portions of the casing string 140 at a distance from the sidewall 103 of the wellbore 102, such as may reduce or inhibit contact and, thus, reduce friction between the portions of the casing sting and the sidewall 103. For example, the rotatable members 310 of each conveyance apparatus 300 may contact the sidewall 103 of the wellbore 102 to lift the body 302 and at least a portion of the casing joints 136, 138 coupled with the conveyance apparatus 300 away from the sidewall 103. Each conveyance apparatus 300 may maintain a space or gap between the sidewall 103 of the wellbore 102 and the body 302 (and at least a portion of the casing joints 136, 138 coupled with the body 302) that is about equal to the distance 312. The rotatable members 310 may further permit the corresponding portion of the casing string 140 to roll in an axial (i.e., longitudinal) direction along the sidewall 103 to reduce friction between the portions of the casing sting 140 and the sidewall 103.

FIGS. 13-16 are perspective, side, side sectional, and axial views, respectively, of at least a portion of an example implementation of a conveyance apparatus 400 according to one or more aspects of the present disclosure. The conveyance apparatus 400 is shown coupling together or otherwise coupled between opposing upper and lower casing joints 136, 138. The following description refers to FIGS. 2 and 13-16, collectively.

The conveyance apparatus 400 may be, comprise, or operate as a casing collar and, thus, be utilized instead of a conventional casing collar (e.g., an instance of the casing collars 134 shown in FIG. 1) to threadedly or otherwise couple two casing joints together. Prior to performing the casing running operations, a conveyance apparatus 400 may be coupled to each casing joint to form the box end of the casing joint. Thereafter, during the casing running operations, the pin ends of the new casing joints may be coupled with the box ends (i.e., conveyance apparatuses 400) of the previously connected casing joints protruding from the wellbore 102.

The conveyance apparatus 400 may comprise a body 402 (e.g., a sleeve, a collar, a housing) having a generally tubular geometry with an inner surface 403 defining an axial bore extending therethrough to permit fluid passage between the upper and lower casing joints 136, 138 coupled with the conveyance apparatus 400. The body 402 may comprise an upper coupling means 404 for mechanically coupling the conveyance apparatus 400 with a corresponding lower coupling means 137 of the upper casing joint 136, and a lower coupling means 406 for mechanically coupling the conveyance apparatus 400 with a corresponding upper coupling means 139 of the lower casing joint 138. The interface means 404 may be or comprise internal (i.e., female) threads configured to threadedly engage with corresponding external (i.e., male) threads of the lower coupling means 137, and the interface means 406 may be or comprise internal threads configured to threadedly engage with corresponding external threads of the upper coupling means 139.

The conveyance apparatus 400 may further comprise a plurality of rollable or otherwise rotatable members 410 rotatably connected with and distributed circumferentially around the body 402. Each rotatable member 410 may be or comprise a roller bearing having a generally cylindrical geometry and configured to rotate about a corresponding shaft (not shown) defining an axis of rotation extending substantially perpendicularly with respect to a central axis 401 of the conveyance apparatus 400. At least a portion of each rotatable member 410 may be disposed past an outer surface 408 of the body 402 by a predetermined distance 412 in a lateral or otherwise radially outward direction with respect the central axis 401.

The rotatable members 410 may be coupled with or otherwise supported by one or more annular members 420 (e.g., rings, collars, sleeves, etc.) disposed around the body 402. The annular members 420 may be rotatably connected with the body 402, such as may permit the annular members 420 to rotate around (i.e., about) the body 402 such that axis of rotation of each annular member 420 coincides with the central axis 401. Each annular member 420 may be rotatably connected with the body 402 via a bearing assembly, such as a ball bearing, comprising a plurality of balls 418 disposed within opposing grooves or channels located along an inner surface of each annular member 420 and the outer surface 408 of the body 402. Other means for rotatably connecting the annular members 420 with the body 402 may include roller bearings, plain bearings, and fluid bearing, among other examples.

Figure 16:
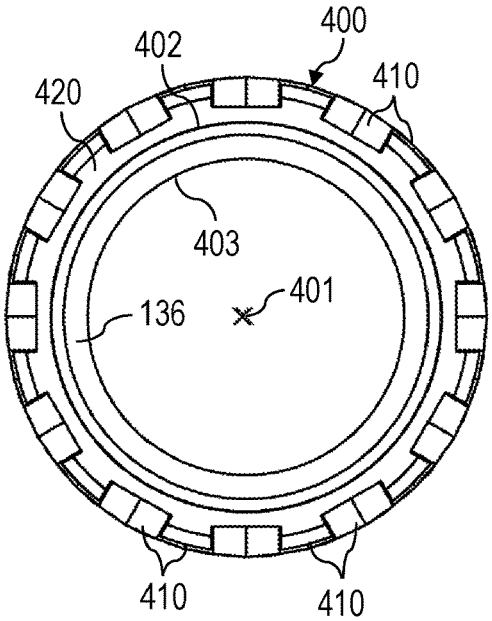
FIG. 16 is an axial view of the apparatus shown in FIG. 14 according to one or more aspects of the present disclosure.
Figure 14:
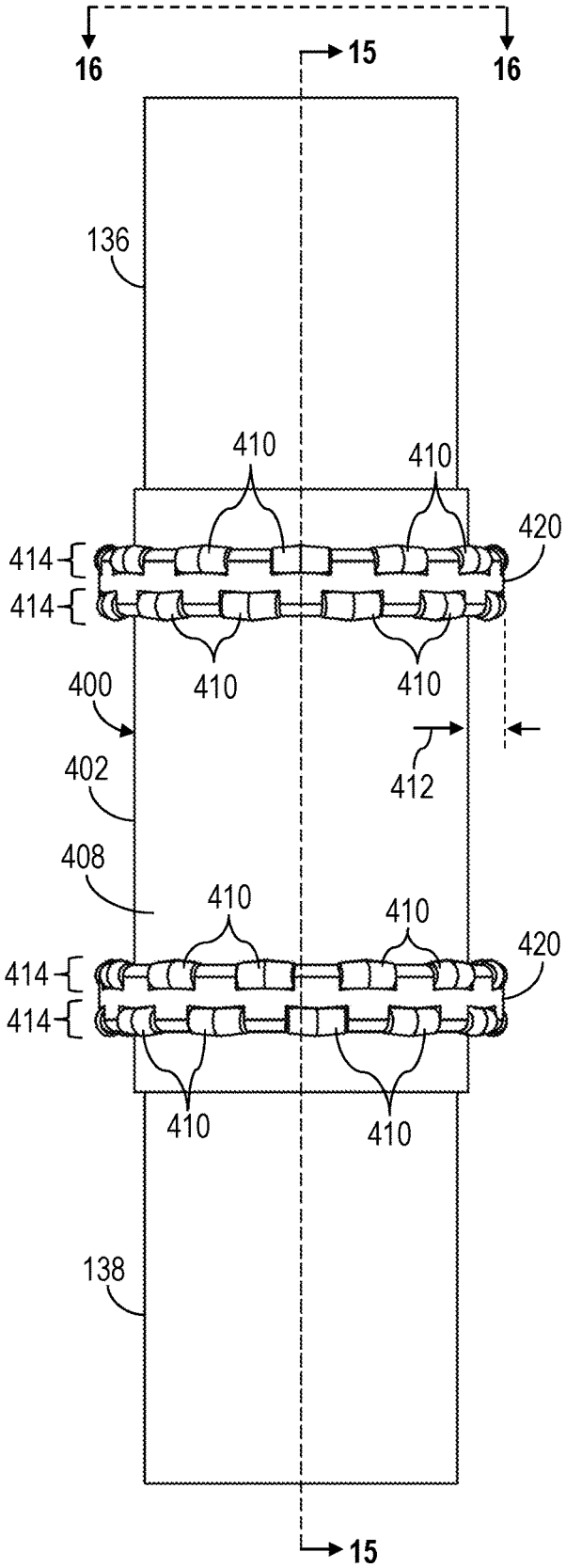
FIG. 14 is a side view of the apparatus shown in FIG. 13 according to one or more aspects of the present disclosure.
Figure 15:
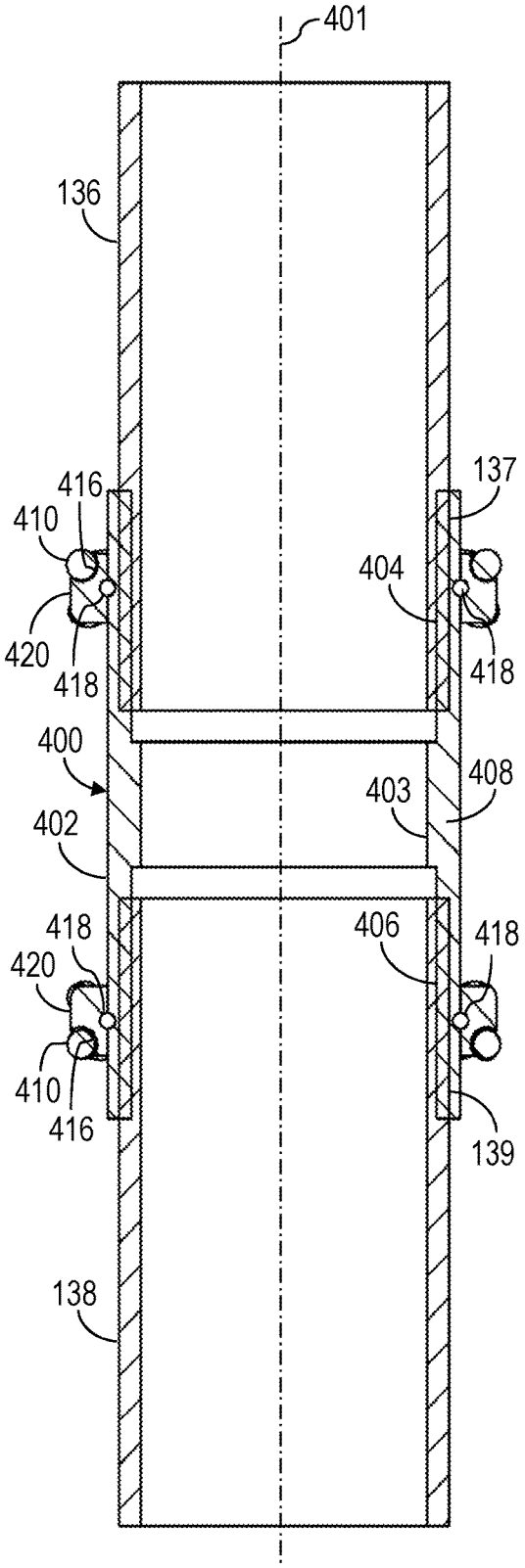
FIG. 15 is a sectional view of the apparatus shown in FIG. 14 according to one or more aspects of the present disclosure.
Figure 17:
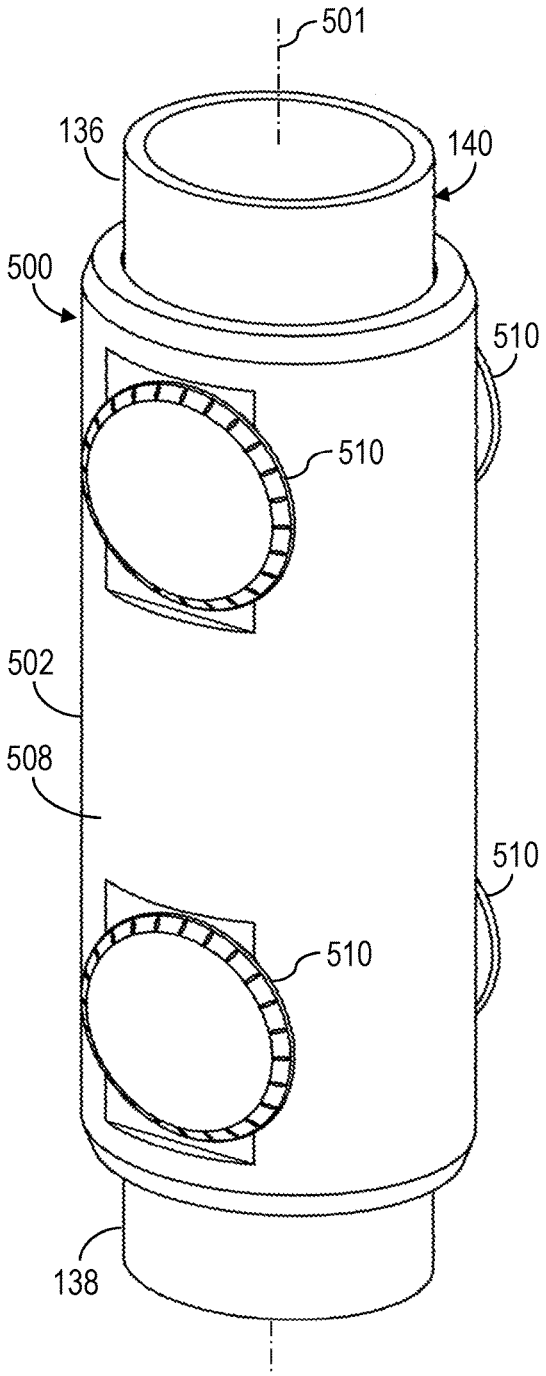
FIG. 17 is a perspective view of at least a portion of an example implementation of apparatus according to one or more aspects of the present disclosure.
Figure 18:
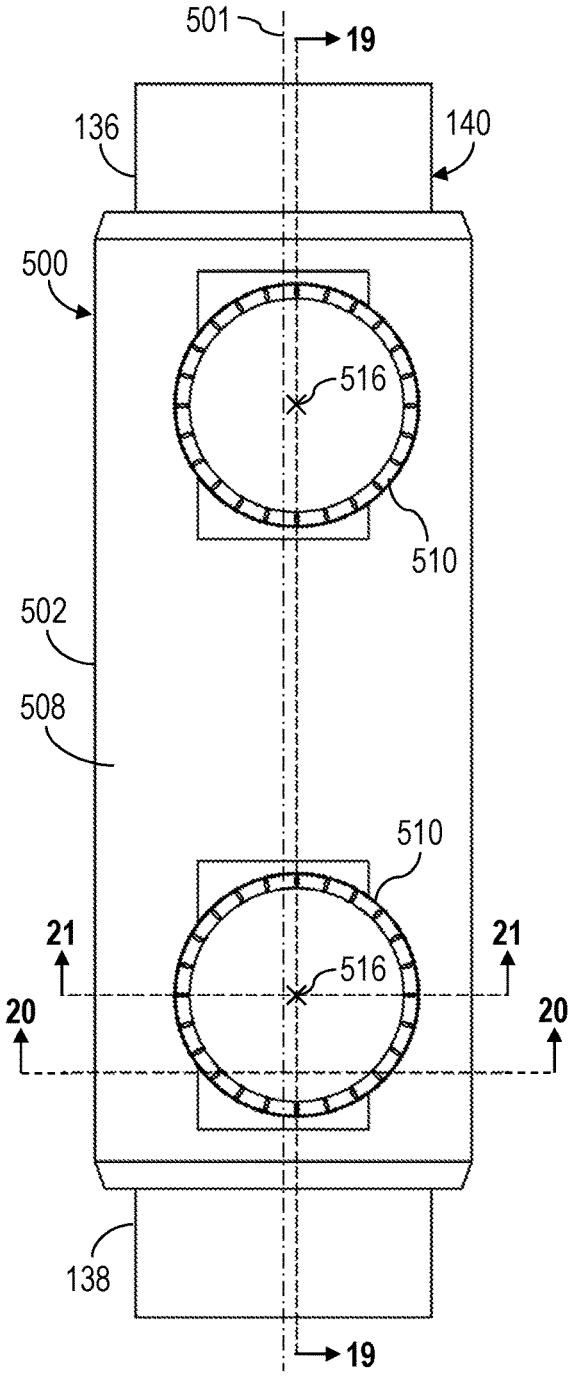
FIG. 18 is a side view of the apparatus shown in FIG. 17 according to one or more aspects of the present disclosure.

At least a portion of each rotatable member 410 may extend or protrude from or past an outer surface of a corresponding annular member 420 in a lateral or otherwise radially outward direction with respect the central axis 401. Each rotatable member 410 may be disposed in a corresponding cavity 416 extending into the outer surface of the annular member 420 and retained within the cavity 416 via a corresponding shaft (not shown), which may extend through the cavity 416 and into the annular member 420 on opposing sides of the cavity 416. Each annular member 420 may carry one or more sets 414 of rotatable members 410, each set 414 comprising a plurality of rotatable members 410 distributed circumferentially around the body 402 along a different circumferential curve. Each set 414 of rotatable members 410 may be located at a different axial position along the annular member 420 and with respect the central axis 401. The rotatable members 410 of one or more sets 414 of rotatable members 410 may be azimuthally offset from the rotatable members 410 of one or more other sets 414 of rotatable members 410. Accordingly, although each set 414 of rotatable members 410 is shown comprising twelve rotatable members 410 distributed circumferentially around the body 402 every thirty degrees, the azimuthal offset results in the rotatable members 410 of the conveyance apparatus 400 being distributed circumferentially around the body 402 every fifteen degrees, as shown in FIG. 16. Although the conveyance apparatus 400 is shown comprising two annular member 420 carrying the rotatable members 410, it is to be understood that the conveyance apparatus 400 may comprise one, three, or more annular member 420 carrying the rotatable members 410. Furthermore, although each annular member 420 is shown supporting two sets 414 of rotatable members 410, it is to be understood that each annular member 420 may support one, three, or more set 414 of rotatable members 410. Also, although each set 414 of rotatable members 410 is shown comprising twelve rotatable members 410, it is to be understood that each set 414 of rotatable members 410 may comprise a lesser or a greater quantity of rotatable members 410.

During casing running operations, the conveyance apparatuses 400 may collectively lift or support at least portions of the casing string 140 at a distance from the sidewall 103 of the wellbore 102, such as may reduce or inhibit contact and, thus, reduce friction between the portions of the casing sting 140 and the sidewall 103. For example, the rotatable members 410 of each conveyance apparatus 400 may contact the sidewall 103 of the wellbore 102 to lift the body 402 and at least a portion of the casing joints 136, 138 coupled with the body 402 away from the sidewall 103. Each conveyance apparatus 400 may maintain a space or gap between the sidewall 103 of the wellbore 102 and the body 402 (and at least a portion of the casing joints 136, 138 coupled with the body 402) that is about equal to the distance 412. The rotatable members 410 may further permit the corresponding portion of the casing string 140 to roll in an axial (i.e., longitudinal) direction along the sidewall 103 and, thus, reduce friction between the portions of the casing sting 140 and the sidewall 103. The ability of the annular members 420 to rotate about the body 402 may permit the casing string 140 to rotate (e.g., roll, turn) within the wellbore 102, such as to reduce or inhibit torsional stresses along the casing string 140 and/or to maintain the casing string 140 against the low side of the wellbore 102.

FIGS. 17-21 are perspective, side, sectional side, and two sectional axial views, respectively, of at least a portion of an example implementation of a conveyance apparatus 500 according to one or more aspects of the present disclosure. The conveyance apparatus 500 is shown coupled between and partially around opposing upper and lower casing joints 136, 138. The conveyance apparatus 500 may be utilized in addition to a conventional casing collar (e.g., an instance of the casing collars 134 shown in FIG. 1) for threadedly or otherwise coupling together the upper and lower casing joints 136, 138. The conveyance apparatus 500 may be coupled with the casing string 140 around, with, or otherwise in association with an instance of the casing collar 134 forming the casing string 140. The following description refers to FIGS. 1 and 17-21, collectively.

The conveyance apparatus 500 may comprise a body 502 (e.g., a sleeve, a collar, a housing) having a generally tubular geometry. The body 502 may comprise an inner surface 503 defining an axial bore extending therethrough for receiving or accommodating the casing collar 134 and the casing joints 136, 138. The body 502 may be configured to engage the casing collar 134 and/or the casing joints 136, 138 in a manner preventing axial movement of the conveyance apparatus 500 with respect the casing collar 134 and the casing joints 136, 138. The inner surface 503 may comprise a larger inner diameter portion 520 (e.g., a channel extending into the inner surface 503 in a radially outward direction with respect to a central axis 501 of the conveyance apparatus 500 and circumferentially along the inner surface 503) configured to receive or accommodate the casing collar 134 when the conveyance apparatus 500 is coupled around the casing collar 134 and the upper and lower casing joints 136, 138. The inner surface may further comprise smaller inner diameter portions 522, 524 on opposing sides of the larger inner diameter portion 520 configured to receive or accommodate portions of the upper and lower casing joints 136, 138, respectively, when the conveyance apparatus 500 is coupled around the casing collar 134 and the upper and lower casing joints 136, 138. A transition surface or shoulder 526 may extend radially between each smaller inner diameter portion 522, 524 and the larger inner diameter portion 520. Accordingly, when the conveyance apparatus 500 is coupled around the casing collar 134 and the upper and lower casing joints 136, 138, each shoulder 526 may contact an opposing edge or shoulder of the casing collar 134 extending laterally from the upper and lower casing joints 136, 138 to prevent or otherwise limit axial movement of the conveyance apparatus 500 with respect to the casing collar 134 and, thus, prevent or otherwise limit longitudinal movement of the conveyance apparatus 500 along the casing string 140.

Figure 20:
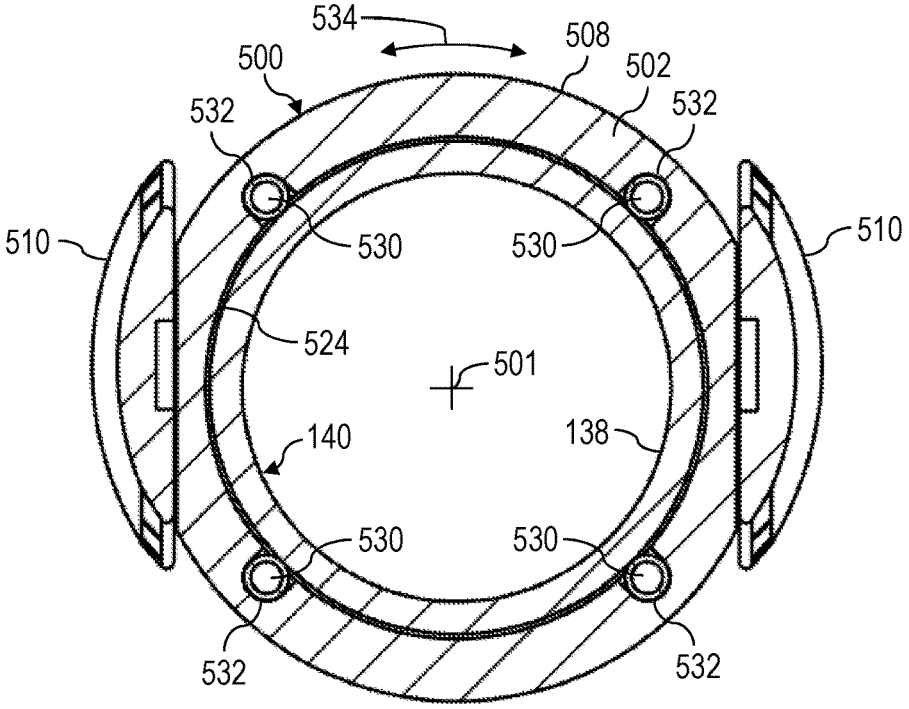
FIG. 20 is a sectional axial view of the apparatus shown in FIG. 18 according to one or more aspects of the present disclosure.

As shown in FIG. 20, the conveyance apparatus 500 may further comprise a plurality of rollable or otherwise rotatable members 530 distributed along the inner surface 503 of the body 502, such as may permit the conveyance apparatus 500 to rotate about the casing collar 134 and the upper and lower casing joints 136, 138, as indicated by arrows 534, when the conveyance apparatus 500 is coupled around the casing collar 134 and the upper and lower casing joints 136, 138. The rotatable members 530 may be arranged in one or more sets of rotatable members 530, each set comprising a plurality of rotatable members 530 distributed circumferentially along the inner surface 503 of the body 502. Each set of rotatable members 530 may be located at a different axial position along the body 502. Each rotatable member 530 may protrude laterally inward (i.e., radially inward with respect the central axis 501) from the inner surface 503 of the body 502 by a predetermined distance to form an annular space or offset between the body 502 and the casing collar 134, the upper casing joint 136, and the lower casing joint 138, and, thus, prevent or inhibit contact between the body 502 and the casing collar 134, the upper casing joint 136, and the lower casing joint 138. Each rotatable member 530 may be disposed in a corresponding cavity 532 extending into the inner surface 503 within a wall of the body 502 and retained within the cavity 532 via a corresponding shaft (not shown), which may extend through the cavity 532 and into the wall of the body 502 on opposing sides of the cavity 532. Each shaft may define an axis of rotation extending substantially parallel to the central axis 501 of the conveyance apparatus 500. Each rotatable member 530 may be or comprise a roller bearing having a generally cylindrical geometry. However, it is to be understood that the rotatable members 530 may be or comprise other rotatable members, such as ball bearings and wheels.

The conveyance apparatus 500 may further comprise a plurality of rollable or otherwise rotatable members 510 rotatably connected with the body 502 and extending laterally outward (i.e., radially outward with respect the central axis 501 of the conveyance apparatus 500) from an outer surface 508 of the body 502. The rotatable members 510 may collectively facilitate rolling along the sidewall 103 of the wellbore 102 and thereby facilitate axial conveyance of at least a portion of the casing joints 136, 138 and casing collar 134 coupled with the conveyance apparatus 500. A plurality of conveyance apparatuses 500 may form a portion of or be coupled with a casing string 140 and, thus, collectively facilitate axial conveyance of the casing string 140 within the wellbore 102. Each conveyance apparatus 500 may be configured to support the corresponding casing joints 136, 138 at an intended offset distance from the sidewall 103. The rotatable members 510 may extend laterally outward from the outer surface 508 of the conveyance apparatus 500 by a predetermined distance 512. Each rotatable member 510 may be or comprise a wheel configured to rotate about a corresponding shaft 514 extending laterally from the outer surface 508 of the body 502 and defining a corresponding axis of rotation 516 extending substantially perpendicularly with respect to the central axis 501. Each rotatable member 510 may be disk or bowl shaped, comprising curved outer surfaces or profiles (e.g., viewed from a perspective along the central axis 501) each representing a segment of a spheroid having a radius that may be smaller than a radius of a cross-section of the sidewall 103 of the wellbore 102. A ball bearing 515 or another bearing may reduce rotational friction between each shaft 514 and a corresponding rotatable member 510.

Figure 19:
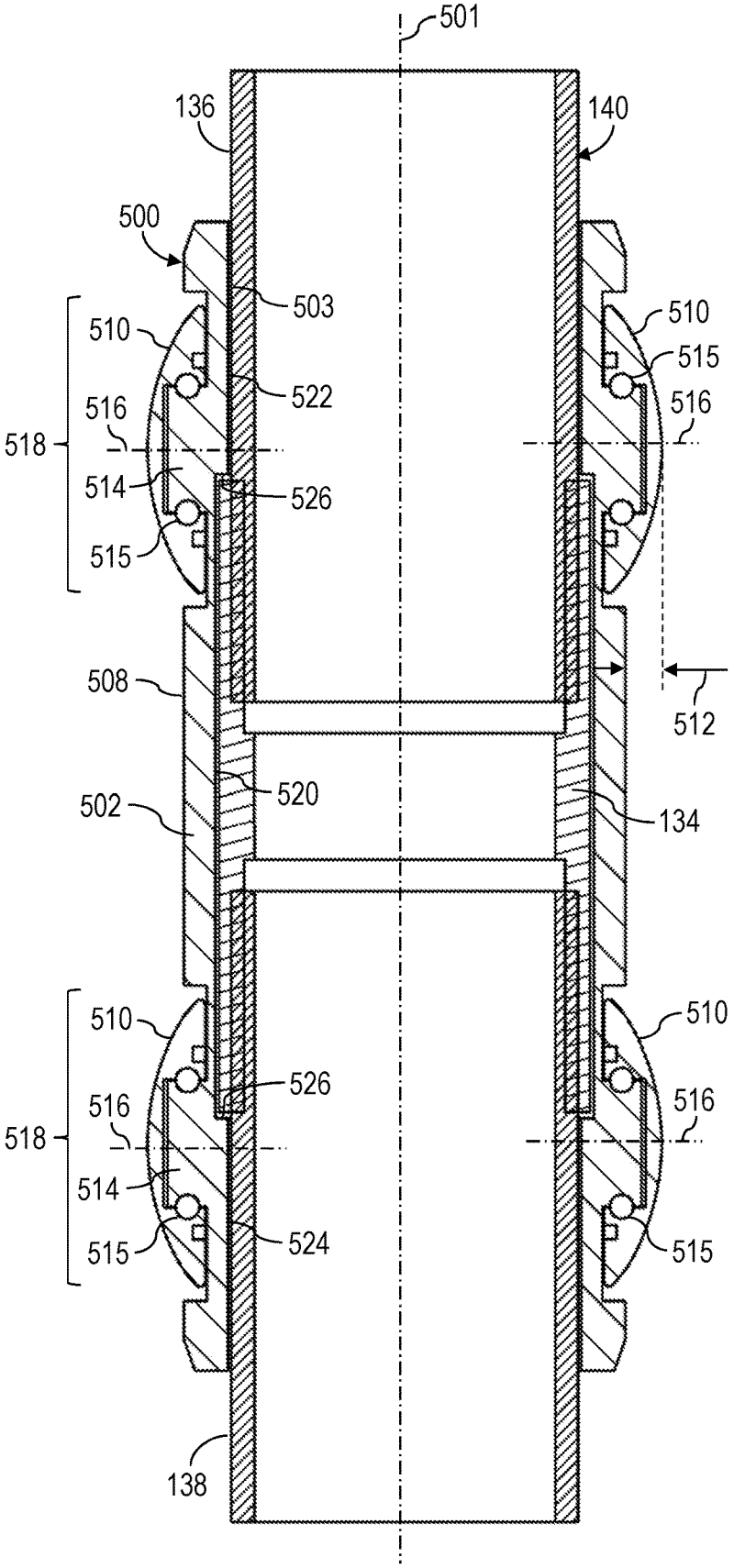
FIG. 19 is a sectional view of the apparatus shown in FIG. 18 according to one or more aspects of the present disclosure.
Figure 21:
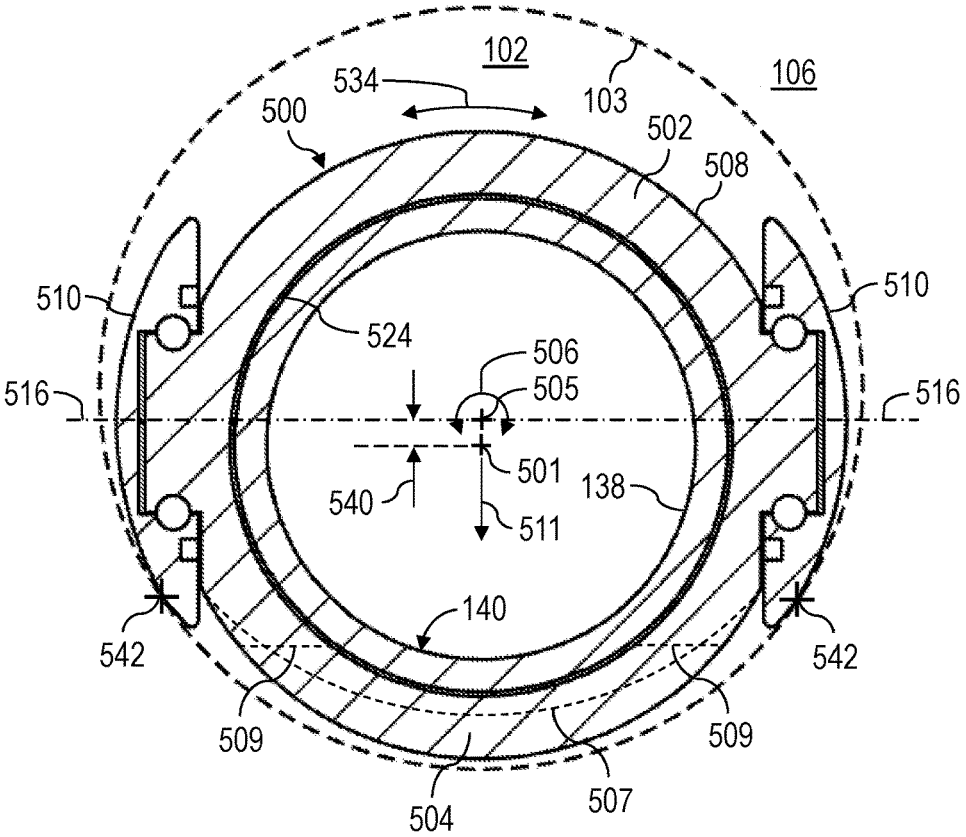
FIG. 21 is another sectional axial view of the apparatus shown in FIG. 18 according to one or more aspects of the present disclosure.

The rotatable members 510 may be arranged in pairs 518, with each rotatable member 510 connected on an opposing side of the body 502. The axes of rotation 516 of each pair 518 of rotatable members 510 may coincide (i.e., be collinear with), as shown in FIGS. 19 and 21. Each pair 518 of rotatable members 510 may be located at a different axial position along the body 502. Although the conveyance apparatus 500 is shown comprising two pairs 518 of rotatable members 510, it is to be understood that the conveyance apparatus 500 may comprise one, three, or more pairs 518 of rotatable members 510. Furthermore, the rotatable members 510 may not necessarily be arranged in pairs 518. Accordingly, each rotatable member 510, corresponding shaft 514, and corresponding axis of rotation 516 may be located at a different axial position along the body 502 such that the axis of rotation 516 of each rotatable member 510 on one side of the body 502 does not coincide with the axis of rotation 516 of another rotatable member 510 on an opposing side of the body 502. The axes of rotation 516 may extend substantially perpendicularly with respect to the central axis 501.

FIG. 21 shows the conveyance apparatus 500 and a portion of the casing string 140 (i.e., casing joint 138) during casing running operations disposed within the non-vertical portion 107 of the wellbore 102 extending through the subterranean formation 106. The axes of rotation 516 of the rotatable members 510 may be radially offset from the central axis 501 of the conveyance apparatus 500 by a predetermined distance 540. The central axis 501 of the conveyance apparatus 500 may coincide with the center of mass of the casing joints 136, 138 and the casing collar 134. Accordingly, the radial offset 540 between the central axis 501 and the axes of rotation 516 of the rotatable members 510 can create a mechanical instability when the central axis 501 is not located below the axes of rotation 516 of the rotatable members 510. Such mechanical instability can result in the gravitational force 511 (i.e., weight of the casing joints 136, 138 and the casing collar 134) causing a torque 506 that urges rotation 534 of the conveyance apparatus 500 around its geometric center 505 toward a mechanically stable and, thus, intended rotational position (i.e., orientation) in which the conveyance apparatus 500 is rotatably oriented 534 such that the central axis 501 is below the axes of rotation 516 of the rotatable members 510 and the rotatable members 510 are in contact with the sidewall 103 of the wellbore 102. The mechanically stable rotational position of the conveyance apparatus 500 is shown in FIG. 21. The torque 506 and, thus, the tendency of the conveyance apparatus 500 to rotate, may be directly proportional to the distance 540 between the central axis 501 and the axes of rotation 516.

During casing running operations, the conveyance apparatuses 500 may collectively lift or support at least portions of the casing string 140 at a distance from the sidewall 103 of the wellbore 102, such as may reduce or inhibit contact and, thus, friction between the portions of the casing sting 140 and the sidewall 103. For example, the rotatable members 510 of each conveyance apparatus 500 may contact the sidewall 103 of the wellbore 102 to lift the body 502 and at least a portion of the casing joints 136, 138 coupled with the body 502 away from the sidewall 103. Each conveyance apparatus 500 may maintain a space or gap between the sidewall 103 of the wellbore 102 and the body 502 (and at least a portion of the casing joints 136, 138 coupled with the body 502) that is about equal to the distance 512. The rotatable members 510 may permit at least portions of the casing string 140 supported by the conveyance apparatuses 500 to roll in an axial (i.e., longitudinal) direction along the sidewall 103 to reduce or inhibit friction between the portions of the casing sting 140 and the sidewall 103. The rotatable members 530 may permit the corresponding portion of the casing string 140 to rotate (e.g., roll, turn) within the wellbore 102, such as to reduce or inhibit torsional stresses along the casing string 140 and/or to maintain the casing string 140 against the low side of the wellbore 102.

During casing running operations, a bottom side portion 504 of the body 502 may be located below points of contact 542 between the rotatable members 510 and the sidewall 103 and, thus, in close proximity to the sidewall 103 at the low side of the wellbore 102. When the wellbore diameter increases, clearance or spacing between the bottom side portion 504 of the body 502 and the sidewall 103 may progressively decrease and may contact the sidewall 103. Accordingly, the bottom side portion 504 of the body 502 may be thinner than as shown in FIG. 21, such as indicated by phantom line 507. Furthermore, the body 502 may extend around a portion of the casing collar 134 and/or the casing joints 136, 138, but not around the entire circumference of the casing collar 134 and/or the casing joints 136, 138 as shown in FIG. 21. For example, the bottom side portion 504 of the body 502 may be at least partially cut off or otherwise omitted, such as along phantom lines 509.

Each conveyance apparatus 500 may be coupled with the casing string 140 around a corresponding casing collar 134 during casing running operations before each pin end of the upper (i.e., new) casing joint 136 threadedly engages a box end (e.g., the casing collar 134) of the lower (previously connected) casing joint 138 protruding from the wellbore 102. For example, each conveyance apparatus 500 may be split along a plane extending radially with respect to the central axis 501, forming opposing upper and lower halves of the conveyance apparatus 500 that may be slipped onto the casing joints 136, 138 before the casing joints 136, 138 are coupled via the casing collar 134. The upper and lower halves may then be coupled together around the casing collar 134, such as via bolts and/or corresponding threading of each half of the conveyance apparatus 500. Each conveyance apparatus 500 may also or instead be coupled with the casing string 140 around a casing collar 134 during casing running operations after each pin end of the upper casing joint 136 threadedly engages the box end of the lower casing joint 138 protruding from the wellbore 102. For example, each conveyance apparatus 500 may be split along a plane extending along (i.e., coinciding with) the central axis 501, forming opposing left and right halves of the conveyance apparatus 500 that may be brought together around the casing joints 136, 138 and the casing collar 134 after the casing joints 136, 138 are coupled via the casing collar 134. The left and right halves may then be coupled together, such as via bolts extending through each half of the conveyance apparatus 500.

Figure 22:
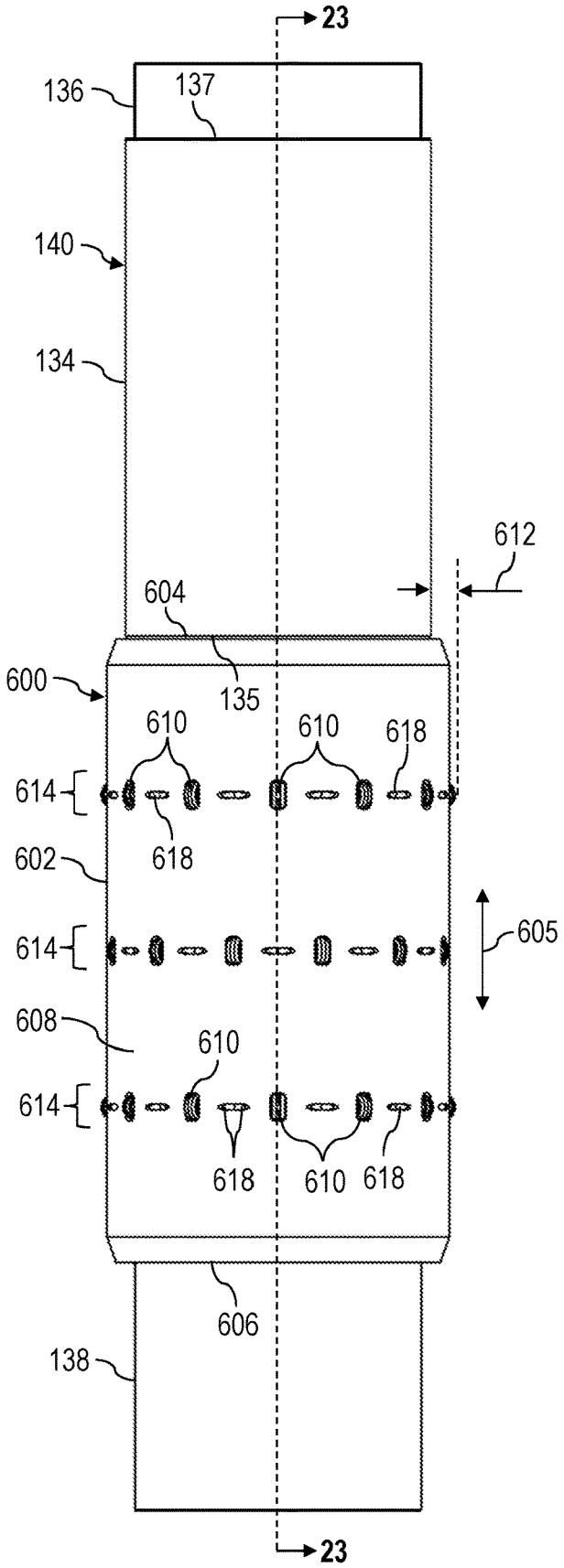
FIG. 22 is a side view of at least a portion of an example implementation of apparatus according to one or more aspects of the present disclosure.
Figure 23:
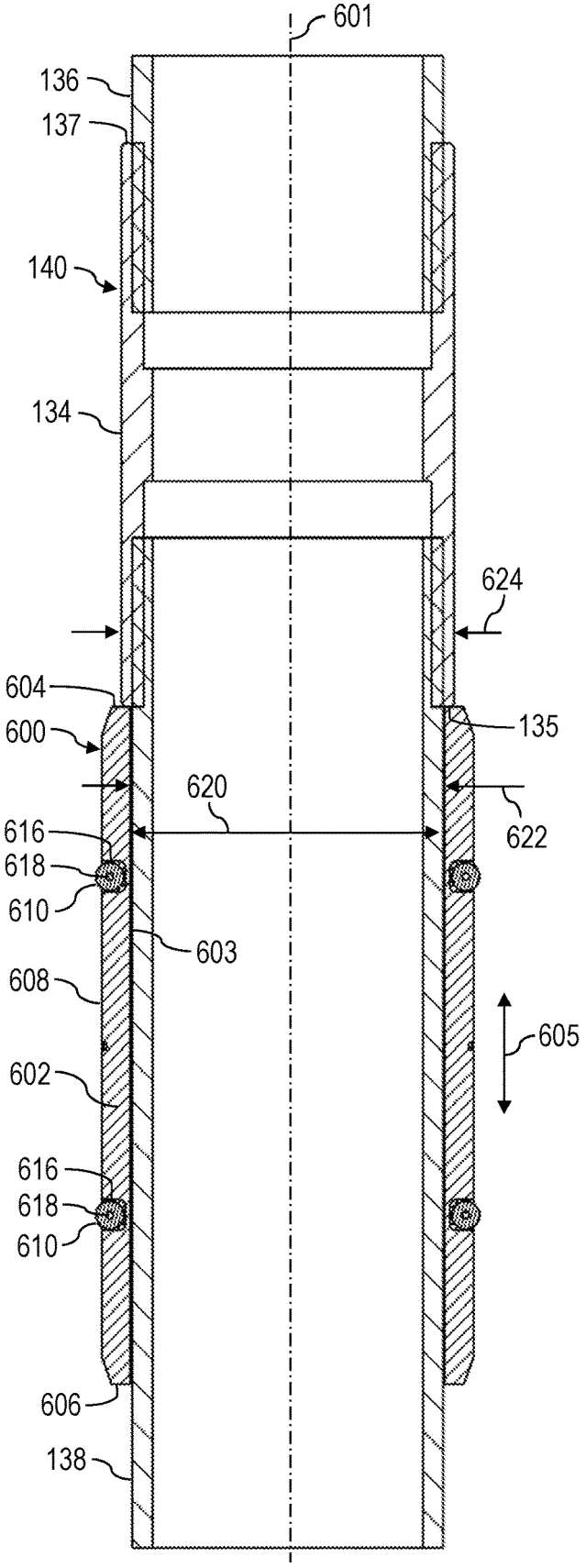
FIG. 23 is a sectional view of the apparatus shown in FIG. 22 according to one or more aspects of the present disclosure.

FIGS. 22 and 23 are side and sectional side views, respectively, of at least a portion of an example implementation of a conveyance apparatus 600 according to one or more aspects of the present disclosure. The conveyance apparatus 600 may be utilized in association with a conventional casing string 140 comprising a plurality of casing joints 132 (e.g., upper and lower casing joints 136, 138) connected together via a plurality of casing collars 134. The conveyance apparatus 600 is shown disposed around a lower casing joint 138 and in contact with the casing collar 134. The following description refers to FIGS. 2, 22, and 23, collectively.

The conveyance apparatus 600 may comprise a body 602 (e.g., a sleeve, a collar, a housing) having a generally tubular geometry. The body 602 may comprise an inner surface 603 defining an axial bore extending therethrough for receiving or accommodating a casing joint 132, such as the lower casing joint 138. The inner surface 603 may have an inner diameter 620 that is slightly larger than an outer diameter 622 of the lower casing joint 138, permitting the conveyance apparatus 600 to slide axially (i.e., longitudinally) along an outer surface of the lower casing joint 138, as indicated by arrows 605. The inner diameter 620 may be smaller than an outer diameter 624 of the casing collar 134, preventing the conveyance apparatus 600 from sliding or otherwise moving over or past the casing collar 134. The body 602 may comprise an upper shoulder 604 configured to contact a lower shoulder 135 of the casing collar 134 in a manner preventing upward axial movement of the conveyance apparatus 600 along the lower casing joint 138 after such contact is made. The body 602 may further comprise a lower shoulder 606 configured to contact an upper shoulder 137 of another casing collar (not shown) at the bottom of the lower casing joint 138 in a manner preventing downward axial movement of the conveyance apparatus 600 along the lower casing joint 138 after such contact is made. Accordingly, when the conveyance apparatus 600 is connected with, installed on, or otherwise disposed around the lower casing joint 138, the conveyance apparatus 600 is permitted to slide axially along the lower casing joint 138 between casing collars 134 at opposing ends of the lower casing joint 138.

The conveyance apparatus 600 may further comprise a plurality of rollable or otherwise rotatable members 610 rotatably connected with and distributed circumferentially around the body 602. At least a portion of each rotatable member 610 may extend or protrude from or past an outer surface 608 of the body 602 by a predetermined distance 612 in a lateral or otherwise radially outward direction with respect a central axis 601 of the conveyance apparatus 600. Each rotatable member 610 may be or comprise a wheel (e.g., having a generally cylindrical geometry) configured to rotate about a corresponding shaft 618 defining an axis of rotation extending substantially perpendicularly with respect to the central axis 601. Each rotatable member 610 may be disposed in a corresponding cavity 616 extending into the body 602 and retained within the cavity 616 via the corresponding shaft 618, which may extend through the cavity 616 and into the body 602 on opposing sides of the cavity 616.

The rotatable members 610 may be arranged in one or more sets 614 of rotatable members 610, each set 614 comprising a plurality of rotatable members 610 distributed circumferentially around the body 602 along a different circumferential curve. Each set 614 of rotatable members 610 may be located at a different axial position along the body 602. The rotatable members 610 of one or more sets 614 of rotatable members 610 may be azimuthally offset from the rotatable members 610 of one or more other sets 614 of rotatable members 610. Accordingly, although each set 614 of rotatable members 610 is shown comprising twelve rotatable members 610 distributed circumferentially around the body 602 every thirty degrees, the azimuthal offset results in the rotatable members 610 being distributed circumferentially around the body 602 every fifteen degrees (similarly as shown in FIG. 11). Although the conveyance apparatus 600 is shown comprising three sets 614 of rotatable members 610, it is to be understood that the conveyance apparatus 600 may comprise one, two, four, or more sets 614 of rotatable members 610. Furthermore, although each set 614 of rotatable members 610 is shown comprising twelve rotatable members 610, it is to be understood that each set 614 of rotatable members 610 may comprise a lesser or a greater quantity of rotatable members 610.

Each conveyance apparatus 600 may be coupled with the casing string 140 around a corresponding casing joint 132 during casing running operations before each pin end of a new casing joint 132 (e.g., upper casing joint 136) threadedly engages a box end 134 (e.g., the casing collar 134) of a previously connected casing joint 132 (e.g., lower casing joint 138) protruding from the wellbore 102. For example, after a pin end of a new casing joint 132 is positioned above and aligned with a box end 134 of a previously connected casing joint 132, a conveyance apparatus 600 may be slipped onto the new casing joint 132 via the pin end of the new casing joint 132. Thereafter, the draw works 120 may lower the new casing joint 132 until the pin end of the new casing joint 132 is at least partially inserted into the box end 134 of the previously connected casing joint 132. The torqueing device 126 may then be moved toward the casing string 140, clamped around the new casing joint 132, and operated to rotate the new casing joint 132 to threadedly engage the pin end of the new casing joint 132 with the box end 134 of the previously connected casing joint 132 to make up the connection. In this manner, the conveyance apparatus 600 is connected with the casing string 140 around the new casing joint 132 between opposing casing collars 134. The draw works 120 may then lower the casing string 140 to advance the casing string 140 downward within the wellbore 102. When the box end 134 of the newly connected casing joint 132 is near the slips and/or the rig floor, the draw works 120 may stop lowering the casing string 140, the slips may close to clamp the newly connected casing joint 132, and the elevator 122 may be detached from the newly connected casing joint 132.

Thereafter, another casing joint 132 may be conveyed to the rig floor, grasped by the elevator 122, and lifted above the previously connected casing joint 132 protruding from the wellbore 102. Another conveyance apparatus 600 may be slipped onto the new casing joint 132 via the pin end of the new casing joint 132. The new casing joint 132 may then be coupled with the previously connected casing joint 132. The slips may be opened again and the draw works 120 may lower the casing string 140 to advance the casing string 140 downward within the wellbore 102. A conveyance apparatus 600 may be disposed around every casing joint 132, every other casing joint 132, or at another predetermined interval or rate. Such casing running operations may be repeated until a predetermined number of conveyance apparatuses 600 are coupled with the casing string 140 and/or the casing string 140 reaches a predetermined length and/or reaches a predetermined depth within the wellbore 102. While the casing string 140 is assembled and lowered along the wellbore, each conveyance apparatus 600 may encounter friction against the sidewall 103 of the wellbore 102, causing each conveyance apparatus 600 to stop moving downward with the casing string 140 or to move downward at a slower rate than the casing string 140 until each conveyance apparatus 600 contacts a casing collar 134 located at an upper end of the casing joint 132 having the conveyance apparatus 600 connected to or disposed thereon.

During casing running operations, each conveyance apparatus 600 may lift or support a corresponding portion of the casing string 140 at a distance from the sidewall 103 of the wellbore 102, such as may reduce or inhibit contact and, thus, reduce friction between each portion of the casing sting 140 and the sidewall 103. For example, the rotatable members 610 of each conveyance apparatus 600 may contact the sidewall 103 of the wellbore 102 to lift the body 602 and at least a portion of the casing string 140 contacting the body 602 away from the sidewall 103. Each conveyance apparatus 600 may maintain a space or gap between the sidewall 103 of the wellbore 102 and the body 602 (and at least a portion of the casing string 140 supported by the conveyance apparatus 600) that is about equal to the distance 612. Each rotatable member 610 may further permit at least a portion of the casing string 140 supported by a conveyance apparatus 600 to roll in an axial direction along the sidewall 103 to reduce friction between the supported portion of the casing sting 140 and the sidewall 103.

Although each conveyance apparatus within the scope of the present disclosure is shown comprising specific features (e.g., types of rotatable members, quantity of rotatable members, sets of rotatable members, connection between the rotatable members and body, structure of the body, means of attachment of the body to a casing joint or casing collar, etc.), it is to be understood that such features are interchangeable and, thus, may be implemented in any combination as part of a conveyance apparatus within the scope of the present disclosure. Thus, the various features of the various conveyance apparatuses within the scope of the present disclosure may be combined as part of conveyance apparatuses not shown in FIGS. 1-23.

In view of the entirety of the present disclosure, including the figures and the claims, a person having ordinary skill in the art will readily recognize that the present disclosure introduces an apparatus comprising a casing collar configured to couple together a first casing joint and a second casing joint, wherein the casing collar comprises: (A) a body comprising: (i) a fluid passage extending axially therethrough; (ii) a first coupler configured to couple the casing collar with the first casing joint; and (iii) a second coupler configured to couple the casing collar with the second casing joint; and (B) a plurality of rotatable members connected to the body, wherein at least a portion of each rotatable member extends from the body in a radially outward direction.

During casing running operations, the rotatable members may be configured to: contact a sidewall of a wellbore to offset from the sidewall at least a portion of the first and second casing joints coupled with the casing collar; and roll along the sidewall to reduce friction between the sidewall and the at least a portion of the first and second casing joints.

The first coupler may comprise first internal threading configured to threadedly engage first external threading of the first casing joint, and the second coupler may comprise second internal threading configured to threadedly engage second external threading of the second casing joint.

Each rotatable member may be partially disposed within a corresponding cavity extending within a wall of the body.

The rotatable members may be or comprise spheres, spherical features, and/or rollers.

The rotatable members may be distributed circumferentially around the body, the plurality of rotatable members may be a plurality of first rotatable members, the casing collar may further comprise a plurality of second rotatable members connected with and distributed circumferentially around the body, at least a portion of each second rotatable member may extend from the body in the radially outward direction, the first rotatable members may be located at a first axial location along the body, the second rotatable members may be located at a second axial location along the body, and the first and second axial locations may be different.

The casing collar may further comprise a ring connected to the body, the rotatable members may be connected to the ring thereby connecting the rotatable members to the body, and the ring may be rotatable around the body.

The present disclosure also introduces an apparatus comprising a conveyance device for connecting with a casing string during casing string assembly operations at a wellsite surface, wherein the conveyance device comprises: a sleeve comprising a central bore configured to accommodate the casing string; and a plurality of rotatable members connected with the sleeve and extending from the sleeve in a radially outward direction.

The rotatable members may be or comprise spheres, spherical features, and/or rollers.

The casing string may comprise a plurality of casing joints coupled together via a plurality of casing collars, and the conveyance device may be configured to be disposed around an instance of the casing joints between opposing instances of the casing collars such that the instance of the casing joints extends through the central bore of the sleeve. The conveyance device may be slidable along the instance of the casing joints between the opposing instances of the casing collars, and the sleeve may comprise opposing shoulders configured to contact corresponding shoulders of the opposing instances of the casing collars to prevent the conveyance device from sliding past the opposing instances of the casing collars.

The casing string may comprise a plurality of casing joints coupled together via a plurality of casing collars, and the conveyance device may be configured to be disposed around an instance of the casing collars such that the instance of the casing collars is disposed within the central bore of the sleeve. The sleeve may comprise opposing shoulders configured to contact corresponding shoulders of the instance of the casing collars to prevent the conveyance device from sliding longitudinally along the casing string.

The conveyance device may be rotatable around the casing string when the conveyance device is connected with the casing string. In such implementations, among others within the scope of the present disclosure, the plurality of rotatable members may be a plurality of first rotatable members, and the conveyance device may further comprise a plurality of second rotatable members connected with the sleeve and extending from the sleeve in a radially inward direction.

The present disclosure also introduces a method comprising: (A) assembling a casing string at a wellsite surface such that the casing string extends within a wellbore, wherein the casing string comprises a plurality of casing joints coupled together via a plurality of casing collars; (B) while the casing string is being assembled, connecting a plurality of conveyance devices along the casing string, wherein each conveyance device comprises: (i) a sleeve comprising a central bore configured to accommodate the casing string; and (ii) a plurality of rotatable members connected with the sleeve and extending from the sleeve in a radially outward direction; and (C) while the casing string is being assembled, lowering the casing string within the wellbore such that the rotatable members roll along the sidewall to reduce friction between the sidewall and the casing string.

Connecting the plurality of conveyance devices along the casing string may comprise, for each conveyance device, inserting the conveyance device over a lower end of an upper casing joint suspended above a casing collar connected with an upper end of a lower casing joint extending out of the wellbore such that the upper casing joint extends through the central bore of the sleeve. In such implementations, among others within the scope of the present disclosure, assembling the casing string at the wellsite surface may comprise, for each casing joint and casing collar, threadedly connecting the lower end of the upper casing joint with the casing collar connected with the upper end of the lower casing joint such that the conveyance device is disposed around the upper casing joint between the casing collar connected with the upper end of the lower casing joint and a casing collar connected with an upper end of the upper casing joint.

Assembling the casing string at the wellsite surface may comprise, for each casing joint and casing collar, threadedly connecting an upper casing joint with a casing collar connected with a lower casing joint extending out of the wellbore. In such implementations, among others within the scope of the present disclosure, connecting the plurality of conveyance devices along the casing string may comprise, for each conveyance device, disposing the conveyance device around the casing collar such that: the casing collar is disposed within the central bore of the sleeve; and opposing shoulders of the sleeve contact corresponding shoulders of the casing collar to prevent the conveyance device from sliding longitudinally along the casing string.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus comprising:

a casing collar configured to couple together a first casing joint and a second casing joint, wherein the casing collar comprises:

a body comprising:

a fluid passage extending axially therethrough;

a first coupler configured to couple the casing collar with the first casing joint; and a second coupler configured to couple the casing collar with the second casing joint;

a ring connected to the body and operable to rotate around the body;

a plurality of rotatable bearings between the body and the ring, wherein the rotatable bearings decrease friction between the body and the ring; and a plurality of rotatable members each rotatably connected to the ring, wherein at least a portion of each rotatable member extends from the ring in a radially outward direction.

2. The apparatus of claim 1 wherein, during casing running operations, the rotatable members are configured to:

contact a sidewall of a wellbore to offset from the sidewall at least a portion of the first and second casing joints coupled with the casing collar; and roll along the sidewall to reduce friction between the sidewall and the at least a portion of the first and second casing joints.

3. The apparatus of claim 1 wherein:

the rotatable members are distributed circumferentially along the ring;

the plurality of rotatable members is a plurality of first rotatable members;

the casing collar further comprises a plurality of second rotatable members each rotatably connected to the ring and distributed circumferentially along the ring;

at least a portion of each second rotatable member extends from the ring in the radially outward direction;

the first rotatable members are located at a first axial location along the ring;

the second rotatable members are located at a second axial location along the ring; and the first and second axial locations are different.

4. The apparatus of claim 1 wherein each of the rotatable bearings is or comprises a ball bearing.

5. The apparatus of claim 1 wherein the rotatable bearings prevent the ring from moving axially along the body thereby connecting the ring to the body.

6. An apparatus comprising:

a conveyance device for connecting with a casing string having a plurality of casing joints coupled together via a plurality of casing collars, wherein the conveyance device comprises:

a sleeve; and a plurality of rotatable members connected with the sleeve and extending from the sleeve in a radially outward directions;

wherein:

the sleeve comprises an inner surface defining a central bore configured to accommodate the casing string;

the sleeve comprises a channel extending circumferentially along the inner surface of the sleeve;

the channel is configured to accommodate an instance of the casing collars;

the conveyance device is configured to connect to the casing string by disposing the conveyance device around the casing string such that the casing string is within the central bore and the instance of the casing collars is within the channel; and each side surface of the channel is configured to contact a corresponding shoulder of the instance of the casing collars to inhibit movement of the conveyance device longitudinally along the casing string.

7. The apparatus of claim 6 wherein the rotatable members are or comprise spheres and/or rollers.

8. The apparatus of claim 6 wherein the conveyance device is rotatable around the casing string when the conveyance device is connected with the casing string.

9. The apparatus of claim 8 wherein the plurality of rotatable members is a plurality of first rotatable members, wherein the conveyance device further comprises a plurality of second rotatable members connected with the sleeve and extending from the inner surface of the sleeve in a radially inward direction, and wherein the second rotatable members decrease friction between the sleeve and the casing string when the conveyance device is connected with the casing string.

10. The apparatus of claim 8 wherein the conveyance device comprises a first conveyance device half and a second conveyance device half, wherein the first conveyance device half and the second conveyance device half are separable, and wherein the first conveyance device half and the second conveyance device half are connectable around the casing string such that the instance of the casing collars is within the channel.

11. The apparatus of claim 8 wherein the conveyance device comprises a geometric centerline, and wherein, when the conveyance device is connected with the casing string, the geometric centerline is radially offset from a center of mass of the casing string thereby causing a torque that urges rotation of the conveyance device around the geometric centerline such that the center of mass of the casing string is below the geometric centerline of the conveyance device.

12. The apparatus of claim 8 wherein each of the rotatable members rotates about a corresponding axis of rotation, and wherein, when the conveyance device is connected with the casing string, each axis of rotation is radially offset from a center of mass of the casing string thereby causing a torque that urges rotation of the conveyance device such that the center of mass of the casing string is below each axis of rotation.

13. The apparatus of claim 6 wherein the conveyance device further comprises a plurality of shafts each extending in a radially outward direction from an outer surface of the sleeve, wherein each of the rotatable members is or comprises a wheel, and wherein each of the rotatable members is connected with and operable to rotate around a corresponding one of the shafts.

14. The apparatus of claim 13 wherein the conveyance device is rotatable around the casing string when the conveyance device is connected with the casing string.

15. The apparatus of claim 6 wherein the conveyance device is configured to be connected with the casing string during casing string assembly operations at a wellsite surface.

16. A method comprising:

connecting a conveyance device to a casing string, wherein the casing string comprises a plurality of casing joints coupled together via a plurality of casing collars, wherein the conveyance device comprises:

a sleeve comprising an inner surface defining a central bore configured to accommodate the casing string, wherein the inner surface comprises a circumferential channel configured to accommodate an instance of the casing collars; and a plurality of rotatable members connected with the sleeve and extending from the sleeve in a radially outward direction, wherein connecting the conveyance device to the casing string comprises disposing the conveyance device around the casing string such that the instance of the casing collars is within the circumferential channel to prevent the conveyance device from sliding longitudinally along the casing string; and lowering the casing string within a wellbore such that the rotatable members roll along a sidewall of the wellbore to reduce friction between the sidewall and the casing string.

17. The method of claim 16 wherein the conveyance device comprises a first conveyance device half and a second conveyance device half, wherein the first conveyance device half and the second conveyance device half are separable, wherein connecting the conveyance device to the casing string comprises bringing together and connecting the first conveyance device half and the second conveyance device half around the casing string such that the instance of the casing collars is within the circumferential channel.

18. The method of claim 16 further comprising assembling the casing string at a wellsite surface such that the casing string extends within the wellbore, wherein connecting the conveyance device to the casing string is performed while the casing string is being assembled.

19. The method of claim 16 wherein the conveyance device comprises a first conveyance device half and a second conveyance device half, wherein the first conveyance device half and the second conveyance device half are separable, wherein connecting the conveyance device to the casing string comprises bringing together and connecting the first conveyance device half and the second conveyance device half around the casing string such that the instance of the casing collars is within the circumferential channel.

20. The method of claim 16 wherein the conveyance device further comprises a plurality of shafts each extending in a radially outward direction from an outer surface of the sleeve, wherein each of the rotatable members is or comprises a wheel, and wherein each of the rotatable members is connected with and operable to rotate around a corresponding one of the shafts.

* * * * *